US007627264B2

(12) United States Patent
Matsushita et al.

(10) Patent No.: US 7,627,264 B2
(45) Date of Patent: Dec. 1, 2009

(54) DEVELOPING DEVICE AND IMAGE FORMING APPARATUS

(75) Inventors: Yuichi Matsushita, Nagoya (JP); Hiroki Mori, Nagoya (JP); Yukiko Nakaya, Konan (JP); Fan Xu, Nagoya (JP); Isao Kishi, Nagoya (JP); Masahiro Ishii, Nagoya (JP); Mitsuru Horinoe, Chita-gun (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 478 days.

(21) Appl. No.: 11/528,687

(22) Filed: Sep. 28, 2006

(65) Prior Publication Data

US 2007/0122182 A1 May 31, 2007

(30) Foreign Application Priority Data

Sep. 30, 2005 (JP) ..... 2005-287545
Jan. 25, 2006 (JP) ..... 2006-016495

(51) Int. Cl.
*G03G 15/08* (2006.01)

(52) U.S. Cl. ..... 399/103

(58) Field of Classification Search ..... 399/103, 399/102, 105

See application file for complete search history.

(56) References Cited

U.S. PATENT DOCUMENTS 5,029,316 A * 7/1991 Koiso ..... 399/102
5,057,868 A 10/1991 Sekino et al.
5,170,212 A * 12/1992 DeCecca ..... 399/103
5,293,199 A * 3/1994 Saito et al. ..... 399/103
5,321,473 A * 6/1994 Azami ..... 399/103
6,498,914 B2 * 12/2002 Hashimoto et al. ..... 399/103
6,690,900 B2 * 2/2004 Dougherty et al. ..... 399/103
6,697,585 B2 * 2/2004 Dougherty et al. ..... 399/103
6,760,555 B2 * 7/2004 Dougherty et al. ..... 399/103
6,901,228 B2 5/2005 Kamimura et al.
7,457,560 B2 * 11/2008 Nakaya et al. ..... 399/103
2002/0025182 A1 * 2/2002 Park ..... 399/103
2002/0028086 A1 * 3/2002 Sato et al. ..... 399/103
2005/0008402 A1 * 1/2005 Mizutani et al.

FOREIGN PATENT DOCUMENTS

JP 54-059943 5/1979
JP 2-210476 8/1990
JP 5-035069 2/1993

(Continued)

OTHER PUBLICATIONS

Japanese Office Action: Patent Application No. 2006-016495, Dec. 2, 2008.

*Primary Examiner*—Susan S Lee
(74) *Attorney, Agent, or Firm*—Banner & Witcoff, Ltd.

(57) ABSTRACT

A developing device is provided that includes a developer containing case that contains a developer. The developer containing case includes a case main body and a supply roller that is rotatably supported on the case main body. The supply roller has a rotary shaft, a cylindrical roller main body that covers the rotary shaft, and a fixed member that is fixed to at least one of the rotary shaft and the roller main body. A gap is provided between an end surface of the roller main body and an inner surface of the case main body, and the fixed member partially occupies the gap.

15 Claims, 18 Drawing Sheets

FOREIGN PATENT DOCUMENTS

| | | |
|---|---|---|
| JP | 07-005756 | 1/1995 |
| JP | 7-036279 | 2/1995 |
| JP | 07-271189 | 10/1995 |
| JP | 08-123165 | 5/1996 |
| JP | 8-205150 | 8/1996 |
| JP | 8-248770 | 9/1996 |
| JP | 10-048927 | 2/1998 |
| JP | 11-109734 | 4/1999 |
| JP | 11-190936 | 7/1999 |
| JP | 11-190941 | 7/1999 |
| JP | 11-258908 | 9/1999 |
| JP | 2001-100522 | 4/2001 |
| JP | 2002-287487 | 10/2002 |
| JP | 2004-333658 | 11/2004 |

* cited by examiner

DEVELOPING DEVICE AND IMAGE FORMING APPARATUS

CROSS REFERENCE TO RELATED APPLICATION

This application claims priority from Japanese Patent Applications No. 2005-287545, filed on Sep. 30, 2005, and No. 2006-016495, filed on Jan. 25, 2006, the entire subject matters of which are incorporated herein by reference.

TECHNICAL FIELD

Aspects of the present invention relate to a developing device having a developer containing case that contains a developer, such as a toner or the like.

Further aspects of the present invention relate to a developing device used in a laser printer or the like, a process cartridge having such a developing device, and an image forming apparatus, such as a laser printer or the like, on which such a process cartridge is mounted.

BACKGROUND

For example, a laser printer performs printing on a recording medium (for example, a printing sheet) using a developer (for example, a toner). The laser printer has a case that contains the developer. The developer containing case has a case main body and a pair of rollers that are rotatably supported on the case main body. One roller is called a supply roller, and the other roller is called a developing roller. The supply roller carries the developer that is contained in the case main body. The supply roller has a rotary shaft and a cylindrical roller main body that covers the rotary shaft. The developing roller comes into contact with the supply roller outside the case main body than the supply roller does. The developing roller and the supply roller rotate while coming into contact with each other, and then the developer is supplied from the supply roller to the developing roller. At this time, the developer is positively or negatively charged by friction between the developing roller and the supply roller. The developing roller carries the positively or negatively charged developer.

The laser printer has a photosensitive member that comes into contact with the developing roller. An electrostatic latent image is formed on the surface of the photosensitive member. The developing roller and the photosensitive member rotate while coming into contact with each other, and then the developer carried on the developing roller is attached to parts of the electrostatic latent image of the photosensitive member. Accordingly, the electrostatic latent image of the photosensitive member becomes a visual image. The developer having the visual image is transferred from the photosensitive member to the recording medium, such that a letter or a drawing is printed on the recording medium.

JP-A-2002-287487 discloses a laser printer having the above-described configuration.

A developing device has a seal member that prevents developer leakage from both longitudinal ends of the developer carrier. For example, JP-A-11-190941 discloses a technique related to a developing device, a process cartridge, and an image forming apparatus that repeats a removal operation of a toner on and in an elastic roller by a scrape roller, a scrape operation of a toner stuck to a wall of a developing container by the elastic roller, and a scrape operation of the toner by the scrape member. According to this technique, an end seal member is provided at an opening of the developing container so as to seal between both ends of a developing sleeve and the developing container. The end seal member comes into contact with peripheral surfaces of both ends of the developing sleeve. Further, a side surface of the end seal member comes into contact with side surfaces of both longitudinal ends of an elastic blade, such that toner leakage from sides of the elastic blade is prevented. In addition, the scrape member is provided at a portion where the elastic blade does not come into contact with the developing sleeve and on the peripheral surfaces of both ends of the elastic roller, that is, portions where the elastic roller comes into contact with the developing sleeve.

With this configuration, the scrape member does not supply the toner from the elastic roller onto the peripheral surfaces of both ends of the developing sleeve, but scrapes the toner. Accordingly, the toner stuck onto the peripheral surfaces in the vicinity of the end seal member of the developing sleeve is made small. Therefore, it is possible to provide a developing device, a process cartridge, and an image forming apparatus that can prevent the toner from entering between the seal member and the developing sleeve.

SUMMARY

A particle diameter of the developer is very small. For this reason, even though the case main body is sealed airtight, the developer may leak outside the case main body. If the developer leaks, various devices disposed at the outside are stained. It is necessary to construct the developer containing case such that the developer can be prevented from leaking.

The inventors have found that the developer carried by the roller main body of the supply roller moves in a rotary shaft direction. That is, it has been found that the developer moves from the roller main body toward an inner surface of the case main body. In this case, the developer that moves toward the inner surface of the case main body may enter a narrow space existing near the inner surface of the case main body (for example, a space between the developing roller and a member sealing the developing roller). When this space is connected to the outside of the case main body, the developer that enters the space may leak to the outside of the case main body.

One aspect of the invention provides a technique that can suppress a developer from leaking from an inner surface of a case main body.

In JP-A-11-190941, if the scrape member is provided, when the scraped toner is stuck to the scrape member itself, an aggregate of the toner is formed. Then, the aggregate may enter the end seal member and cause toner leakage. Accordingly, instead of using the scrape member, if both longitudinal ends of the elastic blade that come into contact with the developing sleeve at a curved surface are processed in cutout shapes, and both longitudinal ends of the elastic blade comes into linear contact with the developing sleeve, the toner is not placed onto the peripheral surfaces in the vicinity of the end seal member of the developing sleeve, and thus toner leakage can be prevented. In this case, however, toner fluidity at both longitudinal ends of the developing sleeve is not undesirable. Further, when the developing device is used for many hours, the scraped toner is stuck little at a time onto a rear side as viewed from the openings of the cutouts of both longitudinal ends of the elastic blade, and thus an aggregate of the toner is formed. Then, the aggregate enters the end seal member, which causes toner leakage.

Accordingly, another aspect of the invention provides a developing device that prevents an aggregate of a developer from occurring and prevents developer leakage from a seal member, a process cartridge, and an image forming apparatus.

The inventors have created a technique that provides a gap between an end surface of the roller main body and the inner surface of the case main body. According to this technique, a developer that moves from a roller main body in a rotary shaft direction enters the gap. Then, the developer rarely reaches the inner surface of the case main body. With this configuration, the developer can be suppressed from leaking from the inner surface of the case main body.

However, the developer that enters the gap remains in the gap. If the developer remains near the inner surface of the case main body, the developer whose place to go is lost may leak from the inner surface of the case main body to the outside of the case main body. If the gap is provided between the end surface of the roller main body and the inner surface of the case main body, the gap can suppress the developer from leaking until the gap is filled with the developer, but developer leakage may occur after the gap is filled with the developer. One aspect of the invention can effectively suppress developer leakage by allowing the developer so as not to remain in the gap between the end surface of the roller main body and the inner surface of the case main body.

DETAILED DESCRIPTION

[General Overview]

Figure 1:
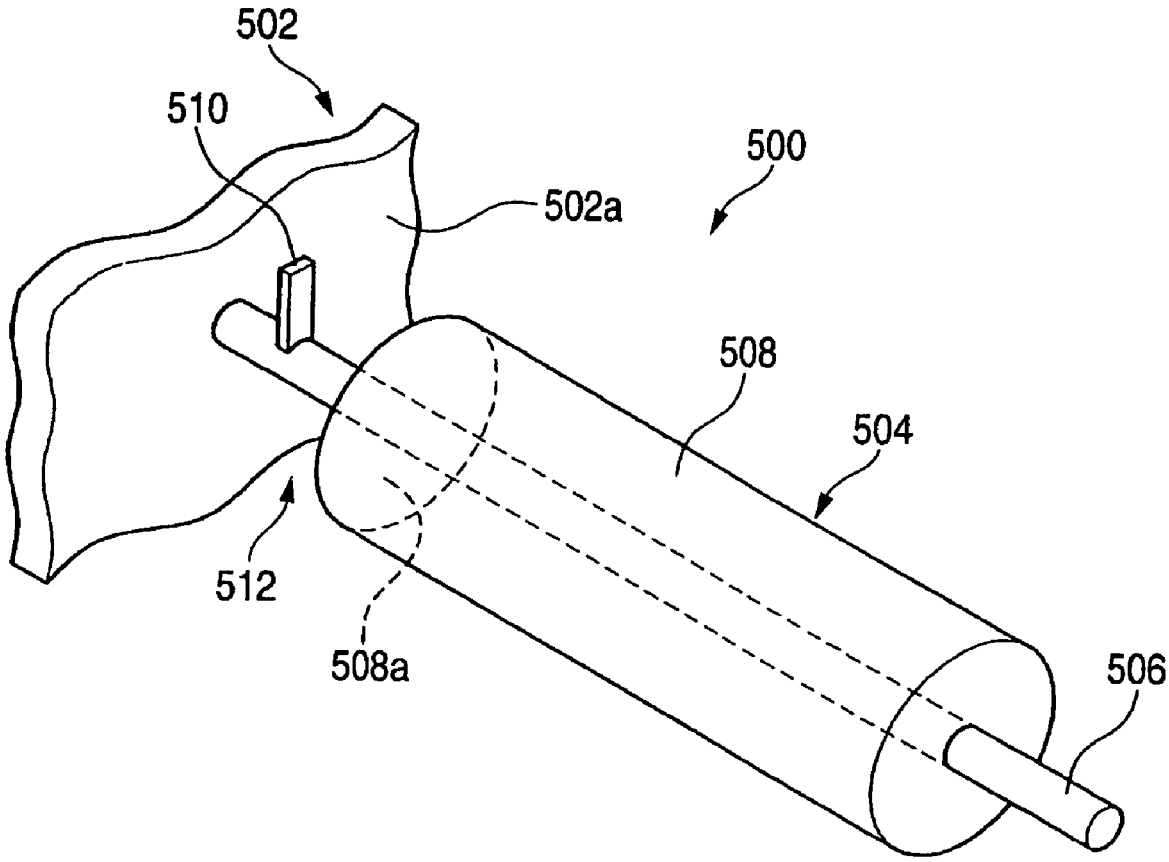
FIG. 1 is a perspective view of a portion of a developer containing case and illustrates the technical concept of an aspect of the invention.
Figure 2:
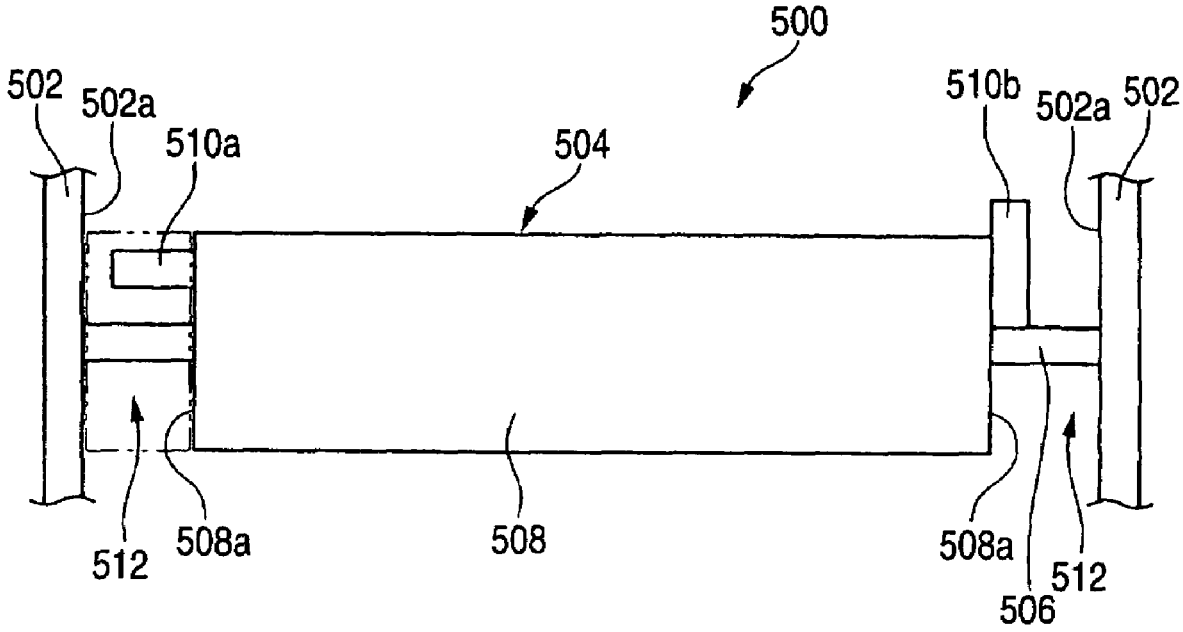
FIG. 2 is a front view of the portion of the developer containing case.

The technique according to one aspect of the invention will be described with reference to FIGS. 1 and 2. FIGS. 1 and 2 are diagrams illustrating the technical concept of the one aspect. A shape or a position of each member is not limited to that shown in the drawing.

FIG. 1 is a perspective view showing a portion of a developer containing case 500. The developer containing case 500 has a case main body 502 and a first roller 504 that is rotatably supported on the case main body 502. The first roller 504 has a rotary shaft 506, a cylindrical roller main body 508 that covers the rotary shaft 506, and a fixed member 510 that is fixed to the rotary shaft 506 and/or the roller main body 508. In FIG. 1, the fixed member 510 is fixed to the rotary shaft 506. A gap 512 is provided between an end surface 508*a* of the roller main body 508 and an inner surface 502*a* of the case main body 502. The fixed member 510 partially occupies the gap 512.

In the developer containing case 500, the gap 512 is provided. The developer that moves from the roller main body 508 in a direction of the rotary shaft 508 enters the gap 512. For this reason, the developer rarely reaches the inner surface 502*a* of the case main body 502. In this technique, when the first roller 504 rotates, the fixed member 510 also rotates. Accordingly, the fixed member 510 can scrape off the developer that enters the gap 512. The developer rarely remains near the inner surface 502*a* of the case main body 502. With the developer containing case 500, developer leakage can be effectively suppressed.

The first roller 504 may be a so-called supply roller or may be a so-called developing roller. Further, other kinds of roller may be used.

The fixed member 510 is not limited to one fixed to the rotary shaft 506. Another example will be described with reference to FIG. 2. FIG. 2 is a front view of a portion of the developer containing case 500. In FIG. 2, a fixed member 510*a* is fixed to the roller main body 508. Further, a fixed member 510*b* is fixed to the rotary shaft 506 and the roller main body 508. With the fixed member 510*a* or 510*b*, the developer that enters the gap 512 can also be scraped off.

The fixed member may be formed separately from the roller main body. The fixed member may be formed integrally with the roller main body.

In the latter case, the roller main body and the fixed member can be formed by cutting a material. With this configuration, since the roller main body and the fixed member can be manufactured from one material, the number of kinds of material required for manufacturing the developer containing case can be reduced.

If the fixed member mostly occupies the gap, the gap is no more meaningful. For this reason, the fixed member preferably has a volume half or less of a volume of the gap.

With this configuration, a gap having a sufficient size can be provided between the end surface of the roller main body and the inner surface of the case main body.

The volume of the gap can be obtained by subtracting, from a volume of a region indicated by a two-dot-chain line of FIG. 2, a volume of the rotary shaft 506 in that region.

The fixed member may have various shapes. Examples of the shape of the fixed member are as follows.

(1) In front view of the end surface of the roller main body, the fixed member may have a rectangular shape that extends from a vicinity of a center of the end surface of the roller main body radially outward.

(2) In front view of the end surface of the roller main body, the fixed member may extend from a vicinity of a center of the end surface of the roller main body radially outward and bend in a reverse rotation direction of the first roller.

(3) In front view of the end surface of the roller main body, the fixed member may have a sectoral shape that is widened from a vicinity of a center of the end surface of the roller main body radially outward.

(4) In front view of the end surface of the roller main body, the fixed member may have a vane shape that extends from a vicinity of a center of the end surface of the roller main body radially outward.

(5) In front view of the end surface of the roller main body, the fixed member may extend beyond the end surface of the roller main body outward. The fixed member 510*b* of FIG. 2 corresponds to this configuration.

(6) The fixed member may extend from the end surface of the roller main body to the inner surface of the case main body.

With any configuration of (1) to (6), the developer that enters the gap can be effectively scraped off.

The developer containing case may further include a second roller that is rotatably supported on the case main body, and a side seal member that is fixed to the case main body. The second roller comes into contact with the first roller outside the case main body than the first roller does. The case main body has a region that opposes a rotary surface of the second roller at an end in a rotary shaft direction of the second roller. The side seal member is disposed in the opposing region and comes into contact with the second roller. The end surface of the roller main body of the first roller may oppose the case main body and the side seal member.

With this configuration, an end of the second roller can be sealed by the side seal member.

The end surface of the roller main body opposes the case main body and the side seal member. If the fixed member is not provided, the developer may remain in the gap between the end surface of the roller main body and the inner surface of the case main body, and the developer may enter a narrow space between the side seal member and the rotary surface (peripheral surface) of the second roller. For this reason, developer leakage may occur. Since the fixed member is provided, the developer rarely remains in the gap between the side seal member and the second roller. As a result, the developer can be effectively suppressed from entering the gap between the side seal member and the second roller.

The side seal member may have a first layer that is fixed to the case main body, and a second layer that is laminated on the first layer and comes into contact with the second roller. The first layer may be formed of an elastic material, and the second layer may be formed of a fiber material.

The first layer is formed of an elastic material, and thus the side seal member can be tightly pressed against the second roller. Further, a general fiber material has a small coefficient of friction. For this reason, the second roller can smoothly rotate while coming into contact with the second layer.

The fixed member may be formed of the same fiber material as the second layer of the side seal member.

With this configuration, the number of kinds of material required for forming the developer containing case can be reduced. Further, since the developer is caught by fiber of the fixed member, the fixed member can effectively scrape off the developer.

The developer containing case may further include a layer-thickness regulating member that is fixed to the main body case. The layer-thickness regulating member comes into contact with the second roller, and regulates a thickness of the developer carried on the second roller. A cutout may be provided at a predetermined position of the layer-thickness regulating member. With this configuration, a contact area of the layer-thickness regulating member with the second roller is larger in a portion other than the cutout, and is smaller at the cutout. If the contact area is large, a low pressure is applied from the layer-thickness regulating member to the second roller. If the contact area is small, a high pressure is applied from the layer-thickness regulating member to the second roller. Then, a developer layer of the second roller is thicker at a portion where the contact area is large, and is thinner at a portion where the contact area is small.

The cutout is provided at a position corresponding to the end in the rotary shaft direction of the second roller. For this reason, at the end in the rotary shaft direction of the second roller, the developer layer is thinned. The end in the rotary shaft direction of the second roller is near the inner surface of the case main body. With this configuration, near the inner surface of the case main body, the developer layer of the second roller can be thinned. Accordingly, it can be seen that the developer rarely leaks from the case inner surface.

In the above-described configuration, the developer enters the cutout of the layer-thickness regulating member. If the developer remains in the cutout, the developer layer of the second roller cannot be thinned by the cutout. In order to avoid this problem, the fixed member preferably has such a length that enters the cutout during rotation of the first roller.

With this configuration, the developer that enters the cutout is removed by the fixed member, and the gap is ready again. With this technique, developer leakage can be effectively suppressed.

[Aspects of the Invention]

Here, features of a technique described in the following aspects are outlined.

(First Feature) A developer containing case is a developer cartridge that is detachably mounted on a main body of an image forming apparatus (for example, a copy machine, a laser printer, a facsimile machine, a compound machine, or the like) that forms images using a developer.

(Second Feature)If the developer cartridge is mounted on a photosensitive member cartridge, a process cartridge can be constructed. A user can replace only the photosensitive member cartridge or only the developer cartridge. The entire process cartridge can be replaced. The photosensitive member cartridge has a photosensitive member. The developing roller of the developer cartridge comes into contact with the photosensitive member.

(Third Feature) An image forming apparatus having a developer containing case is very useful. The image forming apparatus has a photosensitive member and the developer containing case described above. The developer that is carried on a developing roller of the developer containing case is supplied to the surface of the photosensitive member. Then, the developer supplied to the surface of the photosensitive member is transferred to a recording medium.

(Fourth Feature) A fixed member has a first portion that covers a supply roller shaft, and a second portion that extends from the first portion radially outward an end surface of a supply roller main body. A cutout is provided between the first portion and the second portion. With this cutout, the second portion can be easily bent.

(Fifth Feature) The fixed member comes into contact with a second layer of a side seal member during rotation of the supply roller. With this configuration, the fixed member can scrape off the developer stuck to a side surface of the second layer of the side seal member.

(Sixth Feature) The fixed member comes into contact with the developing roller during rotation of the supply roller. With this configuration, the fixed member can scrape off the developer that tends to enter a gap between the side seal member and the developing roller.

(Seventh Feature) The fixed member is bent while coming into contact with the developing roller. Accordingly, the developer stuck to an edge between a contact surface of the side seal member with the developing roller and a side surface of the side seal member can be scraped off.

(First Aspect)

Figure 3:
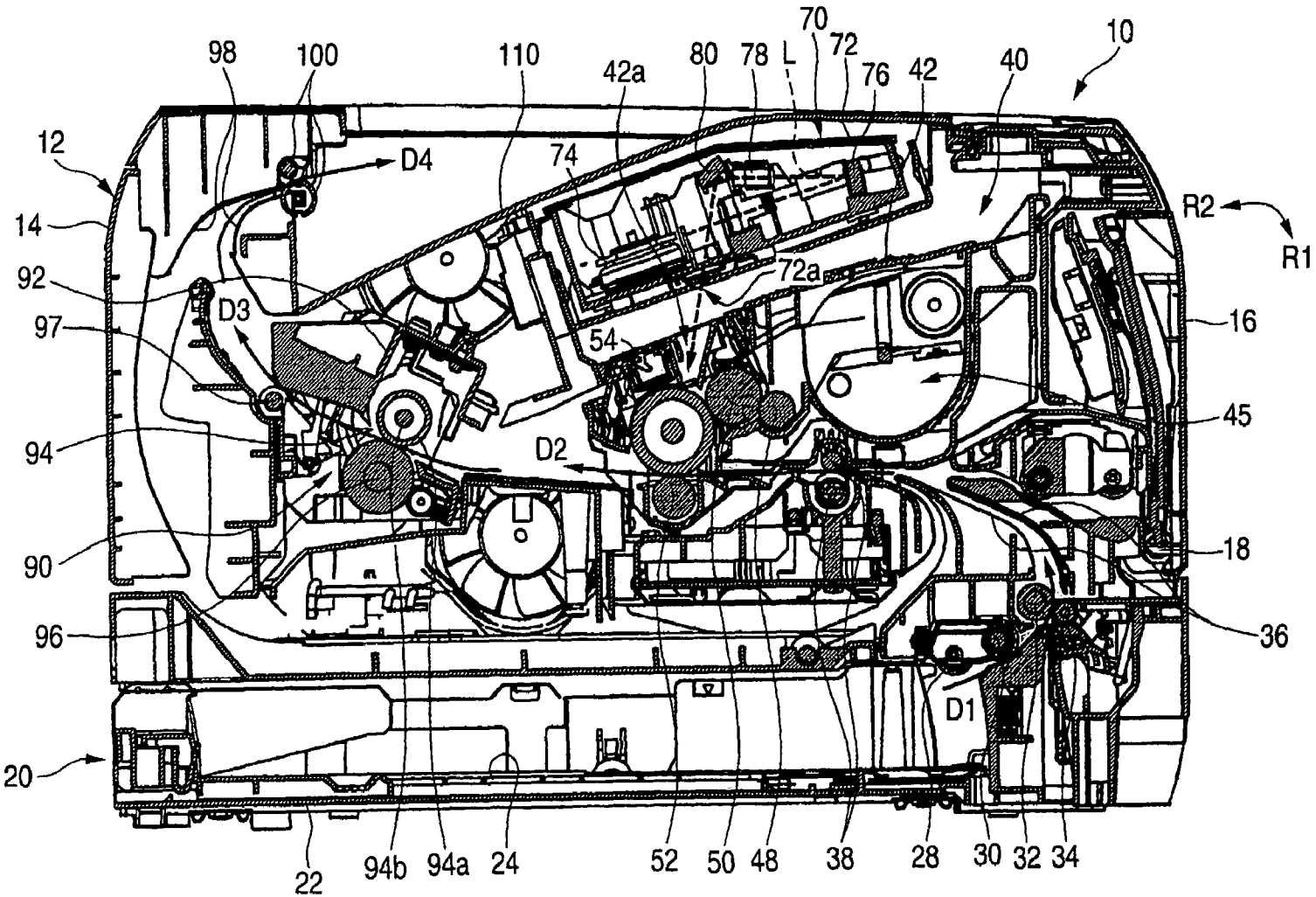
FIG. 3 is a cross-sectional view of a laser printer according to an aspect of the invention.

An aspect of the invention will be described with reference to the drawing. FIG. 3 is a cross-sectional view of a laser printer 10 according to this aspect. Hereinafter, the laser printer 10 is simply referred to as a printer 10. In this aspect, a right direction of FIG. 3 is referred to as a front side of the printer 10.

(Overall Configuration of Laser Printer)

First, the overall configuration of the laser printer 10 will be simply described.

(Configuration of Casing)

The printer 10 has a casing 12. The casing 12 has a plurality of plate members. In FIG. 3, as members forming a portion of the casing 12, a rear cover member 14, a front cover member 16, and the like are shown. The front cover member 16 is pivotable in a direction of an arrow R1 or R2 about a shaft 18. If the front cover member 16 pivots in the direction of the arrow R1, the casing 12 is opened. In this state, a process cartridge 40 described below can be replaced. If the front cover member 16 pivots in the direction of the arrow R2, the casing 12 is closed.

The printer 10 has a sheet feed device 20, a process cartridge 40, an exposure device 70, a toner fixing device 90, and the like. These devices 20, 40, 70, and 90 are disposed in the casing 12. Hereinafter, the devices 20, 40, 70, and 90 will be described in that order.

(Configuration of Paper Feed Device)

The sheet feed device 20 has a sheet feed tray 22, four rollers 28, 30, 32, and 34, and the like. On the sheet feed tray 22, printing sheets (not shown) are stacked. The sheet feed tray 22 has a bottom plate 24 on which the staked printing sheets are placed.

The sheet feed roller 28 rotates in a counterclockwise direction. If the sheet feed roller 28 rotates, an uppermost printing sheet accommodated in the sheet feed tray 22 is fed in a right direction (an arrow D1). The printing sheet fed in the right direction comes into contact with the roller 30. In addition, the printing sheet passes between the rollers 32 and 34. The printing sheet passing between the rollers 32 and 34 is fed between two register rollers 38 along a rail 36.

The lower register roller 38 rotates in a counterclockwise direction. Then, the printing sheet can be fed in a direction of an arrow D2. The upper register roller 38 is driven through the contact with the printing sheet fed by the lower register roller 38 and rotates in a clockwise direction.

If the printing sheet is fed in the direction of the arrow D2 by the register rollers 38, a letter or a drawing is printed on the printing sheet. Specifically, printing is performed by the process cartridge 40, the exposure device 70, and the fixing device 90.

(Configuration of Process Cartridge)

The process cartridge 40 can be attached to and detached from the casing 12. If the front cover member 16 is opened (the arrow R1), the process cartridge 40 can be removed from the casing 12. An old process cartridge 40 can be replaced with a new process cartridge 40.

The detailed configuration of the process cartridge 40 will now be described. Here, the configuration will be simply described. The process cartridge 40 has a casing 42. A through hole 42*a* is formed at an upper surface of the casing 42. A toner chamber 45 is formed on a right side in the casing 42. A toner is contained in the toner chamber 45. Three rollers 48, 50, and 52 and a photosensitive drum 54 are disposed on a left side in the casing 42. Each of the rollers 48, 50, and 52 and the drum 54 is connected to a driving source (not shown). The roller 48 on the right most side is called a supply roller. A developing roller 50 is disposed on the left side of the supply roller 48. The photosensitive drum 54 is disposed on the left side of the developing roller 50. A transfer roller 52 is disposed below the photosensitive drum 54. The printing sheet fed in the direction of the arrow D2 by the register rollers 38 enters between the photosensitive drum 54 and the transfer roller 52. The photosensitive drum 54 rotates in the clockwise direction, and the transfer roller 52 rotates in the counterclockwise direction. With the rotation of the photosensitive drum 54 and the transfer roller 52, the printing sheet is further fed in the left direction (the arrow D2). While the printing sheet is fed in the left direction, the toner stuck to the photosensitive drum 54 is transferred to the printing sheet.

(Configuration of Exposure Device)

The exposure device 70 is disposed above the process cartridge 40. The exposure device 70 is fixed to the casing 12. The exposure device 70 has a casing 72. A through hole 72*a* is formed at a lower surface of the casing 72. In the casing 72, a polygon mirror 74, a reflecting mirror 74, a lens 78, a reflecting mirror 80, and the like are disposed. The exposure device 70 has a light source (not shown). A laser beam is emitted from the light source. The laser beam supplied from the light source is deflected by the polygon mirror 74 and goes toward the reflecting mirror 78. The laser beam is reflected by the reflecting mirror 76 and passes through the lens 78. The laser beam passing through the lens 78 is further reflected by the reflecting mirror 80. The laser beam reflected by the reflecting mirror 80 goes downward from the through hole 72*a* outside the casing 72. The laser beam flying out the casing 72 reaches the photosensitive drum 54 through the through hole 42*a* of the process cartridge 40. Accordingly, the photosensitive drum 54 is exposed in a predetermined pattern. An arrow L of FIG. 3 represents the above-described trace of the laser beam.

(Configuration of Toner Fixing Device)

Next, the configuration of the toner fixing device 90 will be described. The toner fixing device 90 is disposed on a rear side of the process cartridge 40 (a left side of FIG. 3). The toner fixing device 90 has a frame 92, a heating roller 94, and a pressing roller 96.

The frame 92 rotatably supports the heating roller 94 and the pressing roller 96. The heating roller 94 has a metal tube 94*a* and a halogen lamp 94*b* that is disposed in the metal tube 94*a*. The halogen lamp 94*b* heats the metal tube 94*a*. The heating roller 94 rotates in the clockwise direction. The pressing roller 96 is urged toward the heating roller 94 by a mechanism (not shown). If the heating roller 94 rotates in the clockwise direction, the pressing roller 96 is driven by the heating roller 94 and rotates in the counterclockwise direction.

The printing sheet passing through the process cartridge 40 enters between the heating roller 94 and the pressing roller 96. If the heating roller 94 rotates in the clockwise direction, the printing sheet between the heating roller 94 and the pressing roller 96 is fed in the left direction. The printing sheet is heated by the heating roller 94 that is heated at high temperature. Then, the toner transferred to the printing sheet is fixed by heat. The printing sheet passing through the toner fixing device 90 is fed left upward (an arrow D3).

(Configuration of Paper Discharge Mechanism)

A feed roller 97 is disposed immediately below a left end of the frame 92. The feed roller 97 rotates in the counterclockwise direction. The feed roller 97 further feeds the printing sheet fed through the toner fixing device 90 left upward. The printing sheet fed left upward by the feed roller 97 is fed in a right direction along a rail 98 (an arrow D4).

A pair of sheet discharge rollers 100 is disposed on a right side of the rail 98. The lower sheet discharge roller 100 rotates in the clockwise direction. If the lower sheet discharge roller 100 rotates in the clockwise direction, the upper sheet discharge roller 100 is driven by the lower sheet discharge roller 100 and rotates in the counterclockwise direction.

The printing sheet fed by the feed roller 96 enters between the pair of sheet discharge rollers 100. If the lower sheet discharge roller 100 rotates in the clockwise direction, the printing sheet between the two sheet discharge rollers 100 is fed in the right direction. The printing sheet is fed outside the casing 12. A sheet discharge tray 110 is formed at an upper surface of the casing 12. The printing sheet fed outside the casing 12 is discharged on the sheet discharge tray 110.

The overall configuration of the printer 10 has been simply described. Subsequently, the configuration of the process cartridge 40 will be described in detail.

(Detailed Configuration of Process Cartridge)

Figure 4:
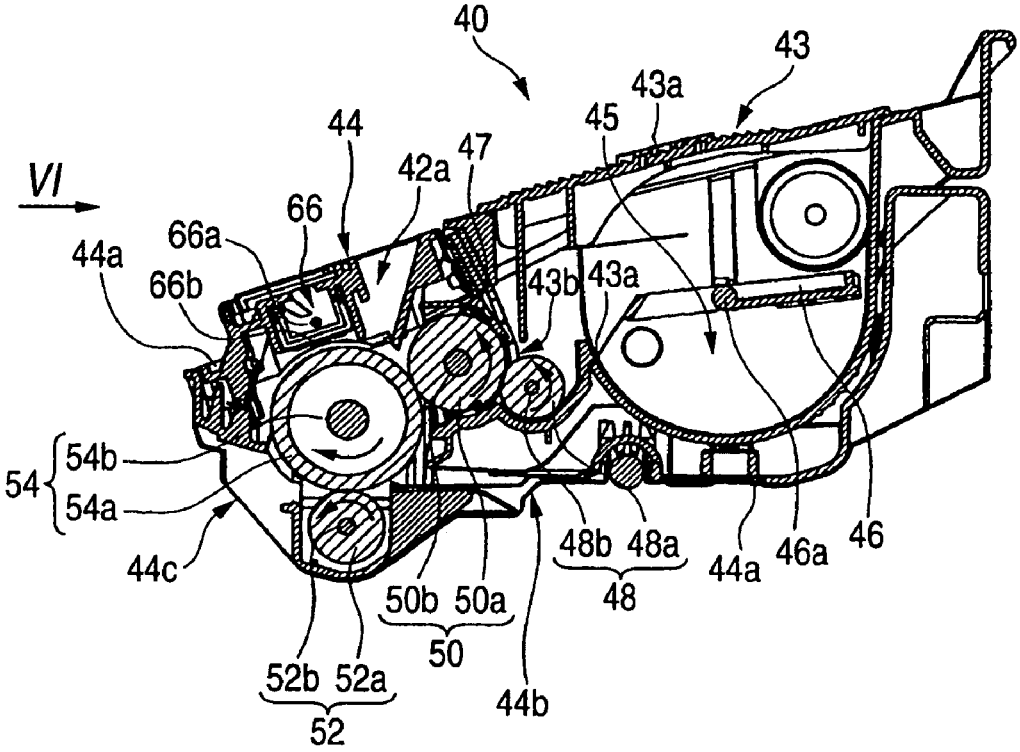
FIG. 4 is an enlarged cross-sectional view of a process cartridge.
Figure 5:
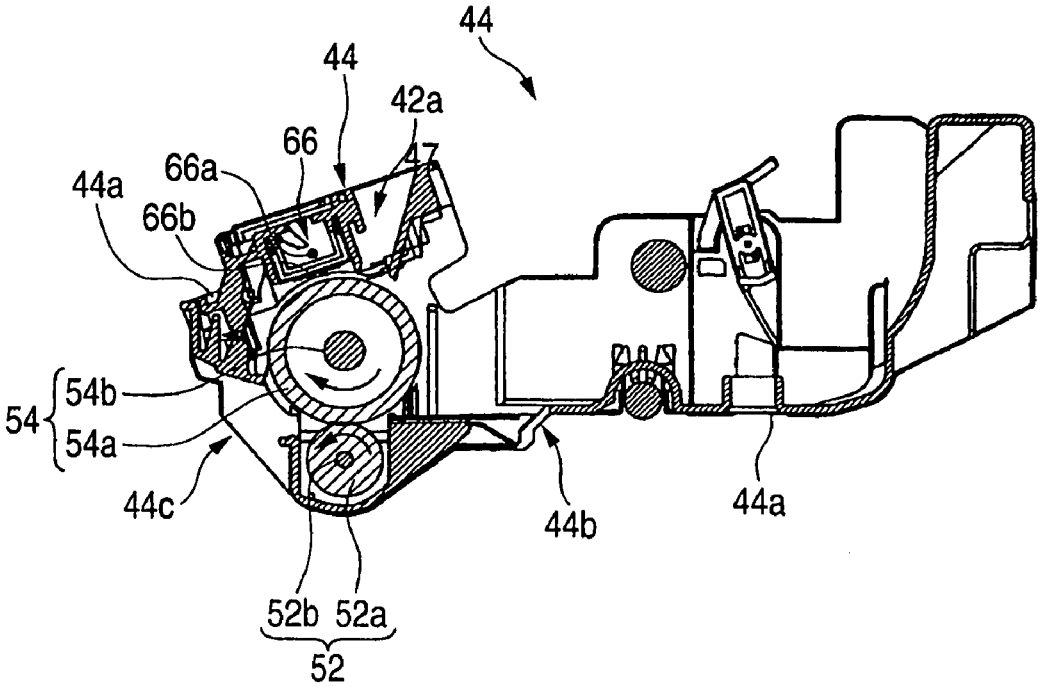
FIG. 5 is a cross-sectional view of a photosensitive member cartridge.

FIG. 4 is an enlarged cross-sectional view of the process cartridge 40. The process cartridge 40 has two cartridges 43 and 44. The cartridge 43 disposed on the right side is called a developer cartridge, and the cartridge 44 disposed on the left side is called a photosensitive member cartridge. The developer cartridge 43 and the photosensitive member cartridge 44 are separatably connected to each other. FIG. 5 is a cross-sectional view of the photosensitive member cartridge 44 after the developer cartridge 43 is separated. According to the process cartridge 40, only the developer cartridge 43 can be replaced and only the photosensitive member cartridge 44 can be replaced. Further, the entire process cartridge 40 can be replaced.

(Configuration of Photosensitive Member Cartridge)

The configuration of the photosensitive member cartridge 44 will be described. The photosensitive member cartridge 44 has a casing 44*a*. A through hole 44*a*, through which the laser beam passes, is formed at an upper surface of the casing 44*a*. An introduction hole 44*b*, which the printing sheet enters, is formed at a lower surface of the casing 44*a*. Further, a delivery hole 44*c*, through which the printing sheet is delivered, is formed at a left side surface of the casing 44*a*. The printing sheet enters the photosensitive member cartridge 44, passes between the photosensitive member cartridge 44 and the transfer roller 52, and is delivered from the delivery hole 44*c*.

The photosensitive drum 54, the transfer roller 52, and a charger 66 are disposed in the casing 44*a* of the photosensitive member cartridge 44.

The photosensitive drum 54 comes into contact with the developing roller 50 on the left side of the developing roller 50. The photosensitive drum 54 has a drum main body 54*a* and a drum shaft 54*b*. The drum main body 54*a* has a cylindrical shape. The drum main body 54*a* is a positively chargeable photosensitive member. The drum main body 54*a* is rotatably attached to the drum shaft 54*b*. The drum shaft 54*b* is fixed to the casing 44*a* of the photosensitive member cartridge 44. The drum main body 54*a* is connected to a driving source (not shown). The drum main body 54*a* rotates in the clockwise direction.

The transfer roller 52 comes into contact with the photosensitive drum 54 on the lower side of the photosensitive drum 54. The transfer roller 52 has a transfer roller main body 52*a* and a transfer roller shaft 52*b*. The transfer roller main body 52*a* has a cylindrical shape that covers the transfer roller shaft 52*b*. The transfer roller shaft 52*b* is rotatably supported on the casing 44*a* of the photosensitive member cartridge 44. The transfer roller 52 rotates in the counterclockwise direction. The transfer roller shaft 52*b* is connected to a voltage supply circuit (not shown). Upon transfer (when the toner attached to the photosensitive drum 54 is transferred to the printing sheet), a bias is applied from the voltage supply circuit to the transfer roller 52.

The charger 66 is disposed above the photosensitive drum 54. A gap is provided between the charger 66 and the photosensitive drum 54. The charger 66 is a Scorotron type. The charger 66 has a discharge wire 66*a* and a grid 66*b*. The discharge wire 66*a* extends in a direction perpendicular to the sheet of FIG. 4. A high voltage is applied to the discharge wire 66*a*. The grid 66*b* is disposed between the discharge wire 66*a* and the photosensitive drum 54. A bias voltage is applied to the grid 66*b*. Accordingly, a discharge amount of the discharge wire 66*a* is adjusted. The high voltage is applied to the discharge wire 66*a* so as to cause a corona discharge, and the bias voltage is applied to the grid 66*b*. Then, the surface of the photosensitive drum 54 (the drum main body 54*a*) is positively charged.

(Configuration of Developer Cartridge)

Next, the configuration of the developer cartridge 43 will be described. The developer cartridge 43 has a case main body 43*a*. The toner chamber 45 is formed in the case main body 43*a*. The toner chamber 45 contains the toner. In this aspect, a positively chargeable non-magnetic single-component toner is used. For example, there is used a polymerized toner obtained by suspended-polymerizing a polymerizing monomer, for example, a styrene-based monomer, acrylic-based monomer, or the like. A sacrylic-basemonomer, acrylicacid, alkyl (C1 to C4) acrylate, alkyl (C1 to C4) metaacrylate, or the like can be adopted. Such a polymerized toner is substantially globular and exhibits excellent fluidity. A coloring agent or a wax is mixed in the polymerized toner. In addition, an additive, such as silica, is added to the toner in order to improve fluidity. An agitator 46 is accommodated in the toner chamber 45. The agitator 46 is rotatably supported on the case main body 43*a* about a shaft 46*a*. If the agitator 46 rotates in the clockwise direction, the toner in the toner chamber 45 is stirred. Accordingly, the toner is supplied to the supply roller 48.

An opening 43*b* is formed at a left surface of the case main body 43*a*. The opening 43*b* extends in the direction perpendicular to the sheet in FIG. 4. The supply roller 48 is disposed on the right side of the opening 43*b*. The developing roller 50 is disposed on the left side of the opening 43*b*. The supply roller 48 and the developing roller 50 are positioned at positions facing the opening 43*b*.

The supply roller 48 has a supply roller main body 48*a*, a supply roller shaft 48*b*, and a fixed member 180 (which is not shown in FIG. 4 but shown in FIG. 6) and the like. The supply roller main body 48*a* has a cylindrical shape that covers the supply roller shaft 48*b*. The supply roller main body 48*a* is formed of a conductive foam material. The supply roller shaft 48*b* is formed of a metal. The supply roller shaft 48*b* is rotatably supported on the case main body 43*a* of the developer cartridge 43. The supply roller 48 rotates in the counterclockwise direction. The fixed member 180 will be described in detail below.

The developing roller 50 is positioned outside the case main body 43*a* than the supply roller 48 does. The developing roller 50 strongly comes into contact with the supply roller 48. The developing roller 50 has a developing roller main body 50*a* and a developing roller shaft 50*b*. The developing roller main body 50*a* has a cylindrical shape that covers the developing roller shaft 50*b*. The developing roller main body 50*a* is formed of a conductive rubber material. As the rubber material, conductive urethane rubber or silicon rubber containing carbon particles or the like can be adopted. The developing roller shaft 50*b* is formed of a metal. The voltage supply circuit (not shown) is connected to the developing roller shaft 50*b*. Upon development (when the toner is attached to the photosensitive drum 54), a bias is applied from the voltage supply circuit to the developing roller 50. The developing roller shaft 50*b* is rotatably supported on the case main body 43*a*. The developing roller 50 rotates in the counterclockwise direction.

A layer-thickness regulating member 47 is fixed to the case main body 43*a*. The layer-thickness regulating member 47 is disposed on the left side of the opening 43*b*. The layer-thickness regulating member 47 extends in the direction perpendicular to the sheet in FIG. 4 and comes into contact with the developing roller 50. The layer-thickness regulating member 47 regulates (adjusts) the thickness of a toner layer formed on the surface of the developing roller 50.

Figure 6:
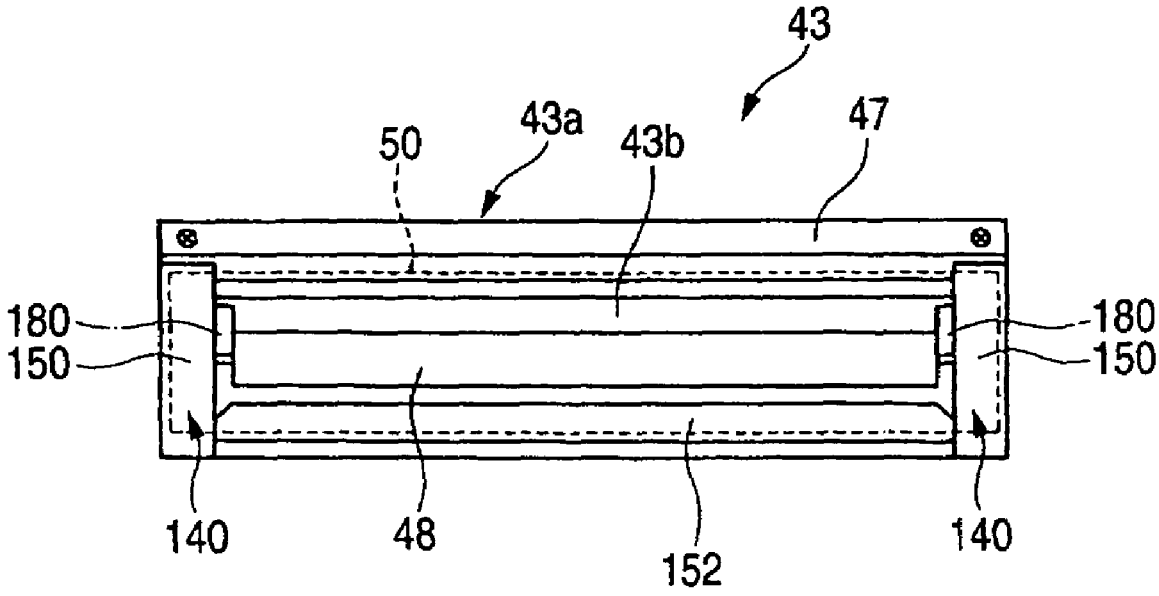
FIG. 6 is a front view of a developer cartridge as viewed from a VI direction of FIG. 4.

FIG. 6 is a front view simply showing the developer cartridge 43 as viewed from a VI direction of FIG. 4. FIG. 6 does not show the photosensitive member cartridge 44. In FIG. 6, the developing roller 50 is indicated by a broken line. The developing roller 50 extends in a left and right direction at a position facing the opening 43*b* of the case main body 43*a*. The layer-thickness regulating member 47 is fixed to an upper portion of the case main body 43*a*. The layer-thickness regulating member 47 extends in the left and right direction.

Regions 140 that oppose the rotary surface of the developing roller 50 (a circumferential surface of the developing roller main body 50*a*) exist at left and right ends of the case main body 43*a*. Side seal members 150 are adhered to the opposing regions 140 of the case main body 43*a*, respectively.

Figure 7:
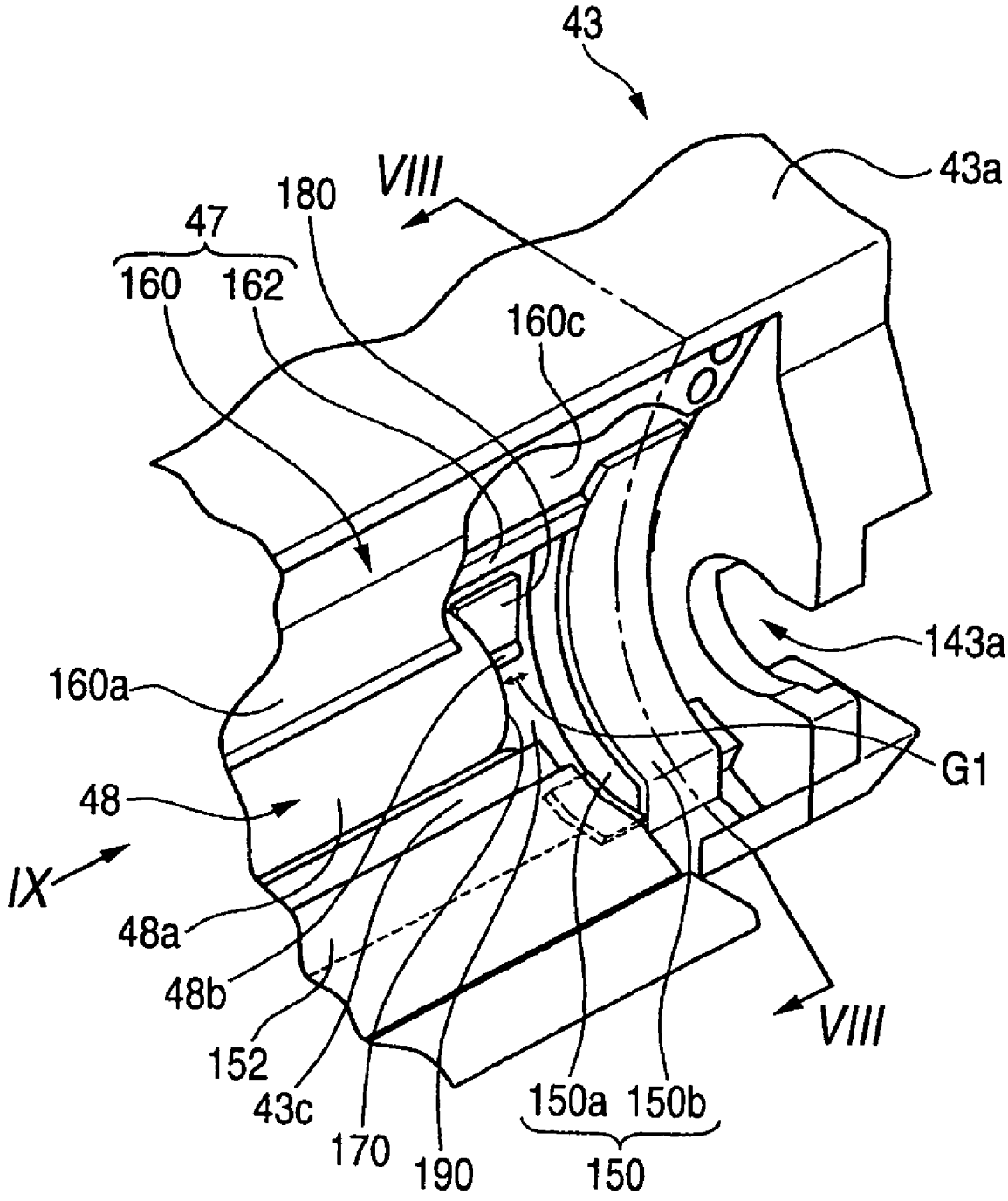
FIG. 7 is a perspective view of a right end of the developer cartridge.

FIG. 7 is a perspective view showing a vicinity of a right end of the developer cartridge 43 (a right end of FIG. 6). The configuration of the right end of the developer cartridge 43 will be described in detail. Since a left end of the developer cartridge 43 is made by inverting the right end of the developer cartridge 43 in the left and right direction, and thus the detailed description thereof will be omitted. In FIG. 7, for better understanding of the configuration of the layer-thickness regulating member 47, a portion of a frame member 160*a* described below is cut.

In FIG. 7, the developing roller 50 is not shown. A hole 143*a* for rotatably supporting the developing roller 50 is provided at the right end of the case main body 43*a*. The developing roller shaft 50*b* (see FIG. 4) extends outward (rightward in FIG. 7) beyond the hole 143*a*.

A lower seal member 152 is adhered to a lower frame 43*c* of the case main body 43*a*. The lower seal member 152 extends over the substantially entire region of the case main body 43*a* in a left and right direction (in a left and right direction of FIG. 6). In FIG. 6, this example is well shown.

Figure 8:
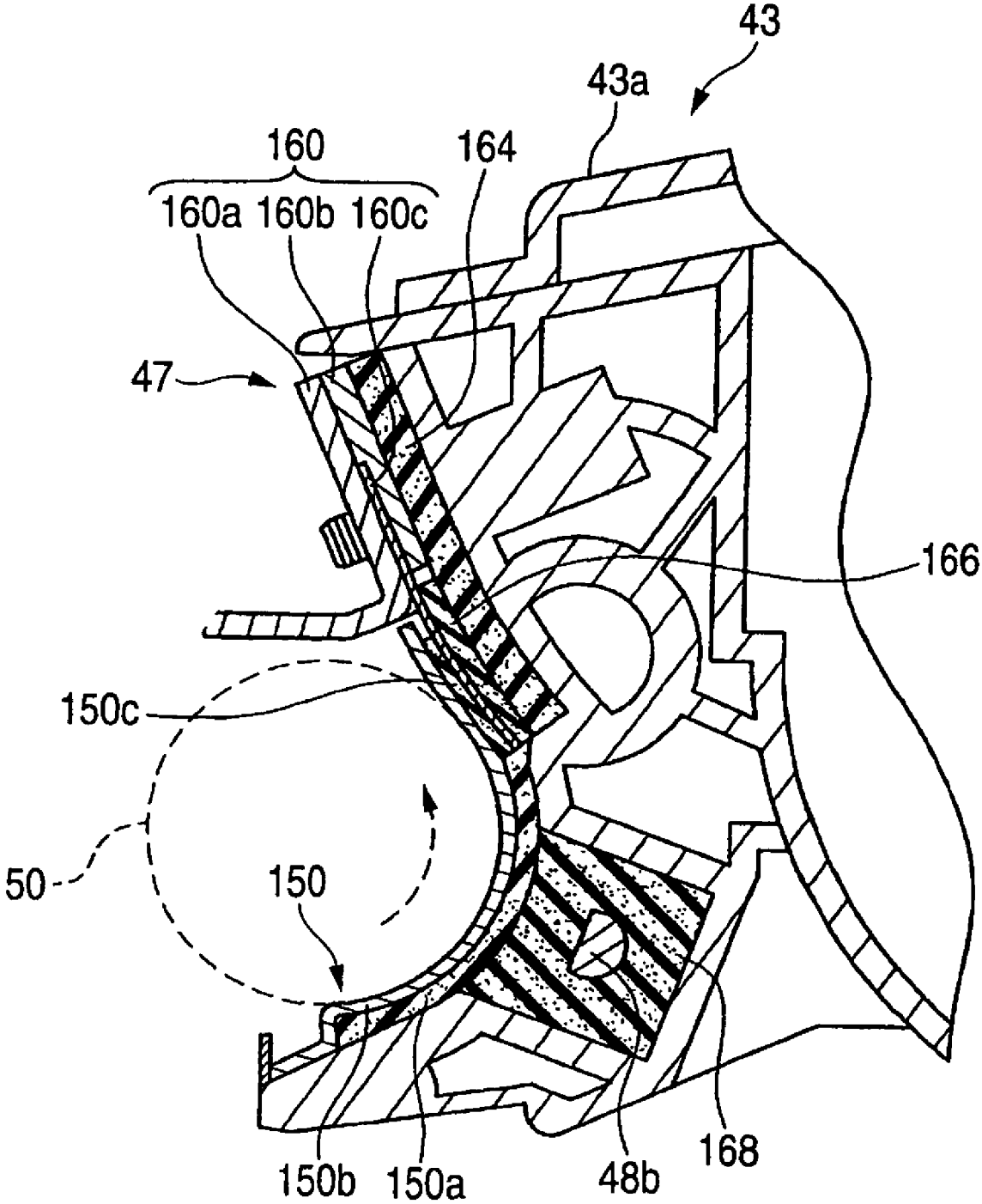
FIG. 8 is a cross-sectional view taken along the line VIII-VIII of FIG. 7.

FIG. 8 is a cross-sectional view taken along the line VIII-VIII of FIG. 7. In FIG. 8, the developing roller 50 is indicated by a broken line. An arrow indicated by a broken line represents a rotation direction of the developing roller 50.

The configuration of the side seal member 150 will be described. The side seal member 150 has a two-layered structure. A lower layer 150*a* of the side seal member 150 is bonded to the opposing region 140 (see FIG. 6) of the case main body 43*a*. The lower layer 150*a* is formed of sponge. An upper layer 150*b* of the side seal member 150 is laminated on the lower layer 150*a*. The upper layer 150*b* is formed of felt. The upper layer 150*b* comes into contact with the rotary surface of the developing roller 50.

The upper layer 150*b* extends upward beyond the lower layer 150*a*. A portion that extends upward beyond the lower layer 150*a* is bonded to a sponge layer 150*c*.

The lower layer 150*a* and the sponge layer 150*c* are formed of elastically deformable sponge, and thus the upper layer 150*b* strongly comes into contact with the developing roller 50. Accordingly, a high shield effect can be obtained.

Next, the configuration of the layer-thickness regulating member 47 will be described in detail. The layer-thickness regulating member 47 has a holding member 160 and a contact member 162. The holding member 160 holds the contact member 162. The contact member 162 is not shown in the cross-sectional view of FIG. 8 but is shown in FIG. 7. The contact member 162 extends in the rotary shaft direction of the developing roller 50 and comes into contact with the substantially entire region in the rotary shaft direction of the developing roller 50. The contact member 162 is formed of rubber.

The holding member 160 has two frame members 160*a* and 160*b* and a stainless plate 160*c*. The front frame member 160*a* (a left side in FIG. 8) has a substantially L shape. The stainless plate 160*c* is interposed between the front frame member 160*a* and the rear frame member 160*b*. The two frame members 160*a* and 160*b* and the stainless plate 160*c* extend in the rotary shaft direction of the developing roller 50 (a direction perpendicular to the sheet in FIG. 8). As shown in FIG. 7, the contact member 162 is bonded to the stainless plate 160*c*. The contact member 162 is not bonded to the left and right ends (the left and right ends of FIG. 6) of the stainless plate 160*c*. The side seal member 150 (portions of the sponge layer 150*c* and the upper layer 150*b*) is bonded to those ends.

A sponge member 164 is disposed between the case main body 43*a* and the rear frame member 160*b*. The sponge member 164 extends in the rotary shaft direction of the developing roller 50. The sponge member 164 seals between the case main body 43*a* and the frame member 160*b*. A sponge member 166 is also disposed between the sponge member 164 and the stainless plate 160*c*. The sponge member 166 also extends in the rotary shaft direction of the developing roller 50 and functions as a sealant.

An elastic member (for example, sponge) 168 that buries a vicinity of the supply roller shaft 48*b* is disposed at a lower portion of the case main body 43*a*. The side seal member 150 is also bonded to the sponge 168.

Returning to FIG. 7, the configuration of a vicinity of the fixed member 180 of the supply roller 48 will be described. As shown in FIG. 7, the supply roller 48 has the fixed member 180. A gap G1 is formed between an end surface 170 of the supply roller main body 48*a* and an inner surface 190 of the case main body 43*a*. The fixed member 180 is disposed so as to partially occupy the gap G1. The end surface 170 of the supply roller main body 48*a* is flat.

Figure 9:
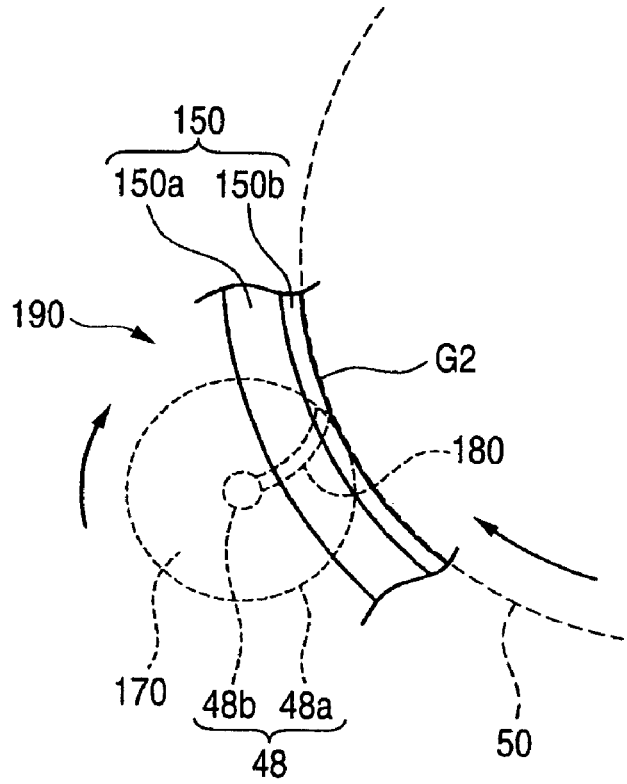
FIG. 9 is a diagram showing a vicinity of a side seal member as viewed from an IX direction of FIG. 7.

FIG. 9 shows the inner surface 190 of the case main body 43*a* and the side seal member 150 as viewed from an IX direction of FIG. 7. In FIG. 9, the supply roller 48 is indicated by a broken line. As shown in FIG. 9, the end surface 170 of the supply roller main body 48*a* opposes the inner surface 190 of the case main body 43*a* and the side seal member 150. Further, the fixed member 180 has such a length that reaches the developing roller 50 (a radial length of the end surface 170 of the supply roller main body 48*a*). In a state shown in FIG. 9, since the fixed member 180 and the developing roller 50 come into contact with each other, the fixed member 180 is bent.

Figure 10:
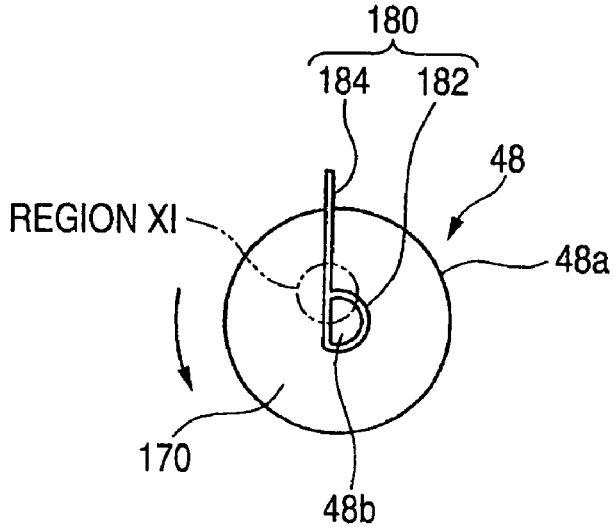
FIG. 10 is a diagram showing an end surface of a supply roller main body in front view.

FIG. 10 shows the end surface 170 of the supply roller main body 48*a*. As shown in FIG. 10, an exposed portion of the supply roller shaft 48*b* (a portion protruding from the supply roller main body 48*a*) has a substantially D shape as viewed from a direction parallel to the sheet of FIG. 10. This example is also shown in FIG. 8. An unexposed portion of the supply roller shaft 48*b* has a columnar shape.

The fixed member 180 is formed of resin (specifically, polypropylene resin). The fixed member 180 has a portion 182 that is formed in a shape corresponding to the D shape of the supply roller shaft 48*b*, and a portion 184 that extends upward from the portion 182. The fixed member 180 is fixed to the supply roller shaft 48*b* by fitting the portion 182 on the supply roller shaft 48*b*.

Figure 11:
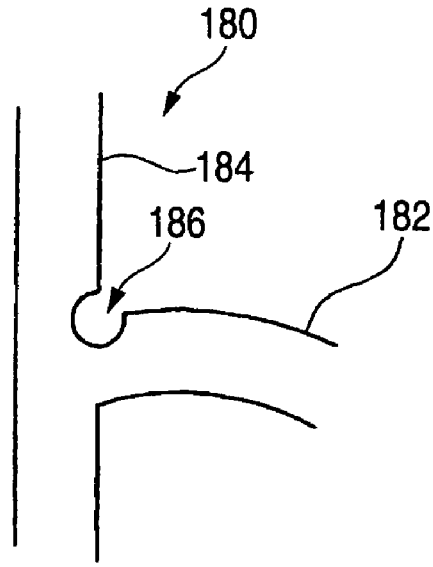
FIG. 11 is an enlarged view of a region XI of FIG. 10.

FIG. 11 is an enlarged view of a region XI of FIG. 10. A cutout 186 is formed between the portion 182 and the portion 184. As viewed from a direction perpendicular to the sheet of FIG. 11, the cutout 186 has a substantially circular shape. The cutout 186 is formed in the fixed member 180 over the entire region in the direction perpendicular to the sheet of FIG. 11. Since the cutout 186 is provided, the portion 184 can be easily bent in a right direction of FIG. 11 (in the clockwise direction).

As will be apparent from FIG. 10, the portion 184 of the fixed member 180 has a rectangular shape that extends from the supply roller shaft 48*b* radially outward the end surface 170 of the supply roller main body 48*a*. The portion 184 extends outward (upward in a state of FIG. 10) beyond the end surface 170 of the supply roller main body 48*a*. The fixed member 180 has a length (a radial length of the end surface 170 of the supply roller main body 48*a*) so as not to come into contact with the layer-thickness regulating member 47 (see FIG. 7) even though the supply roller 48 rotates. Meanwhile, the fixed member 180 has a length so as to come into contact with the developing roller 50 or the lower frame 43*c* during the rotation of the supply roller 48. The cutout 186 (see FIG. 11) is provided in the fixed member 180 such that the fixed member 180 comes into contact with the developing roller 50 or the like to be then easily bent. If the fixed member 180 comes into contact with the developing roller 50 or the lower frame 43*c*, the portion 184 is bent.

The fixed member 180 has a width (a width in the left and right direction of FIG. 6) equal to a distance between the end surface 170 of the supply roller main body 48*a* and the inner surface 190 of the case main body 43*a* (see FIG. 7). That is, the fixed member 180 comes into contact with the end surface 170 of the supply roller main body 48*a* and the inner surface 190 of the case main body 43*a*. Further, the fixed member 180 comes into contact with the upper layer 150*b* and the lower layer 150*a* of the side seal member 150.

(Action of Process Cartridge)

The configuration of the process cartridge 40 will be described in detail. Subsequently, the action of the process cartridge 40 having the above-described configuration will be described with reference to FIG. 4 again.

The toner in the toner chamber 45 is attached to the supply roller 48. The toner attached to the supply roller 48 is positively charged by friction between the supply roller 48 and the developing roller 50. The positively charged toner covers the surface of the developing roller 50. The contact member 162 of the layer-thickness regulating member 47 (see FIG. 7) comes into contact with the toner layer on the surface of the developing roller 50. Accordingly, the toner layer is adjusted to have a constant thickness.

Meanwhile, the surface of the drum main body 54*a* is positively charged by the charger 66. The positively charged surface of the drum main body 54*a* receives the laser beam emitted from the exposure device 70 (see FIG. 3). Accordingly, a predetermined portion of the surface of the drum main body 54*a* is exposed. A potential of the exposed portion of the drum main body 54*a* falls. A portion to be exposed varies according to a printing content. An electrostatic latent image on the basis of the printing content is formed on the drum main body 54*a*.

The toner covering the developing roller 50 is attached to the exposed portion of the drum main body 54*a*. At this time, the toner is not attached to the unexposed portion of the drum main body 54*a*. Accordingly, the electrostatic latent image formed on the drum main body 54*a* becomes a visual image.

The visual image carried on the drum main body 54*a* is transferred to the printing sheet between the photosensitive drum 54 and the transfer roller 52. At this time, a bias is applied to the transfer roller 52. The toner is transferred to the printing sheet by a potential difference between the photosensitive drum 54 and the transfer roller 52.

Through the above-described processes, a desired image (a letter or a drawing) is printed on the printing sheet.

In this aspect, the gap G1 is provided between the end surface 170 of the supply roller main body 48*a* and the inner surface 190 of the case main body 43*a* (see FIG. 7). The toner that moves from the supply roller main body 48*a* in the rotary shaft direction enters the gap G1. Since the gap G1 is provided, the toner can be suppressed from directly moving from the supply roller main body 48*a* to the inner surface 190 of the case main body 43*a*.

The supply roller 48 has the fixed member 180 that partially occupies the gap G1. The fixed member 180 rotates integrally with the supply roller shaft 48*b*. Accordingly, the fixed member 180 scrapes off the toner entering the gap G1.

As will be apparent from FIG. 7 or 10, the fixed member 180 is configured to have a very small volume as compared with a volume of the gap G1. The volume of the fixed member 180 is at least half or less of the volume of the gap G1. Since the volume of the fixed member 180 is small, the volume of the gap G1 is secured large.

The fixed member 180 extends from the end surface 170 of the supply roller main body 48*a* to the inner surface 190 of the case main body 43*a*. Further, the fixed member 180 extends outward beyond the end surface 170 of the supply roller main body 48*a* from the supply roller shaft 48*b*. With this configuration, the fixed member 180 during the rotation can pass through the entire region of the gap G1. Therefore, the fixed member 180 can scrape off the toner over the entire region of the gap G1.

If the fixed member 180 is not provided, the toner remains in the gap G1. In this case, the toner remaining in the gap G1 may enter a narrow gap G2 (see FIG. 9) between the side seal member 150 and the developing roller 150. If the toner moves in the gap G2, the toner may leak from the case main body 43*a*. In this aspect, since the fixed member 180 is provided, the toner does not remain in the gap G1. Therefore, the toner can be prevented from remaining near the inner surface 190 of the case main body 43*a*. Further, the toner can be prevented from entering the gap G2.

As shown in FIG. 9, the fixed member 180 has such a length (the radial length of the end surface 170 of the supply roller main body 48*a*) that reaches the upper layer 150*b* of the side seal member 150. For this reason, the fixed member 180 can scrape off the toner attached to the side surface of the upper layer 150*b*. Further, the fixed member 180 has such a length that comes into contact with the developing roller 50. The fixed member 180 comes into contact with the developing roller 50 to be then bent. Since the fixed member 180 rotates while being bent, it is possible to successfully scrape off the toner that is being attached to the edge between the contact surface of the side seal member 150 with the developing roller 50 and the side surface of the side seal member 150. The fixed member 180 can scraped off the toner that tends to enter between the upper layer 150*b* of the side seal member 150 and the developing roller 50.

According to the technique of this aspect, the toner can be effectively suppressed from leaking from the developer cartridge 43.

(Second Aspect)

Figure 12:
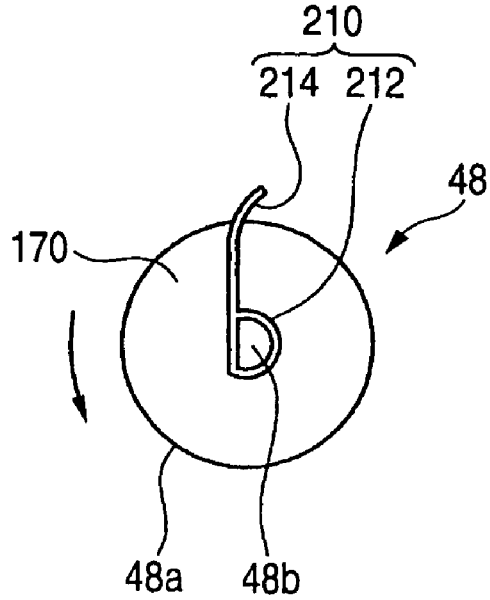
FIG. 12 shows a supply roller according to a second aspect of the invention and is a diagram showing an end surface of a supply roller main body in front view.

FIG. 12 shows a supply roller 48 according to a second aspect of the invention. Here, only different parts from those of the first aspect will be described.

In this aspect, a fixed member 210 has a portion 212 that is fixed in the vicinity of the supply roller shaft 48*b*, and a portion 214 that extends upward from the portion 212. The portion 212 has the same configuration as the first aspect. An upper end of the portion 214 is bent in advance in a right direction of FIG. 12 (in a clockwise direction). This is different from the first aspect. The portion 214 is bent in a reverse rotation direction of the supply roller 48.

Like this aspect, even though the fixed member 210 is bent in advance, it is possible to successfully scrape off the toner that is being attached to the edge between the contact surface of the side seal member 150 with the developing roller 50 and the side surface of the side seal member 150.

(Third Aspect)

Figure 13:
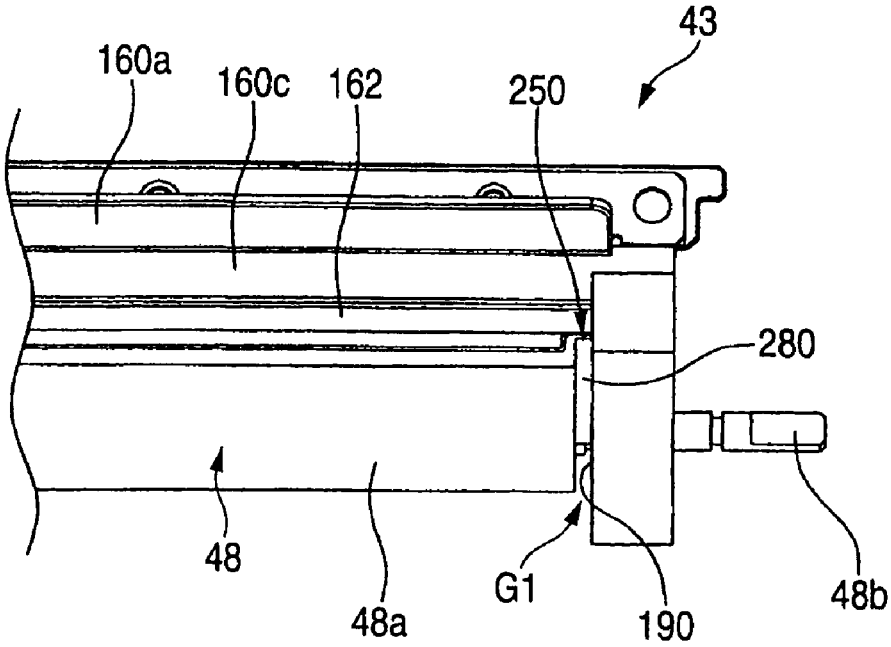
FIG. 13 is a front view showing a portion of a developer cartridge according to a third aspect of the invention.

FIG. 13 is a front view showing a portion of a developer cartridge 43 according to a third aspect of the invention. Here, only different parts from those in the first aspect will be described.

In this aspect, the configuration of the layer-thickness regulating member 47 is different from the first aspect. A cutout 250 is formed in the stainless plate 160*c* and the contact member 162. The cutout 250 is provided at a position corresponding to an end (a right end of FIG. 13) in the rotary shaft direction of the developing roller 50 (not shown). With this configuration, a contact area of the contact member 162 with the developing roller 50 is larger in a portion other than the cutout 250 and is smaller in the cutout 250. If the contact area is large, a low pressure is applied from the contact member 162 to the developing roller 50, and the toner layer of the developing roller 50 is thicker. If the contact area is small, a high pressure is applied from the contact member 162 to the developing roller 50, and the toner layer of the developing roller 50 is thinner.

The cutout 250 is provided at a position corresponding to the end of the developing roller 50 in the rotary shaft direction. For this reason, at the end of the developing roller 50 in the rotary shaft direction, the toner layer is thinner. Then, the end of the developing roller 50 in the rotary shaft direction is close to the inner surface 190 of the case main body 43*a* (see FIG. 7). With this configuration, the toner layer of the developing roller 50 can be thinner near the inner surface 190 of the case main body 43*a*.

If a large amount of the toner exists near the inner surface 190 of the case main body 43*a*, there is a high possibility that the toner leaks from the inner surface 190 of the case main body 43*a*. With the configuration of this aspect, the toner layer of the developing roller 50 near the inner surface 190 of the case main body 43*a* can be thinner. Further, a state where a large amount of the toner exists near the inner surface 190 of the case main body 43*a* can be avoided.

In the above-described configuration, the toner may enter the cutout 250. If the toner enters the cutout 250, the toner may remain near the inner surface 190 of the case main body 43*a*. In this case, toner leakage tends to occur. In order to avoid this situation, the fixed member 280 of this aspect has such a length that enters the cutout 250 during the rotation of the supply roller 48. FIG. 13 shows a state where the fixed member 280 enters the cutout 250.

According to this aspect, the fixed member 280 enters the cutout 250, and thus the toner entering the cutout 250 can be scraped off. Therefore, toner leakage can be effectively suppressed.

(Fourth Aspect)

Figure 14:
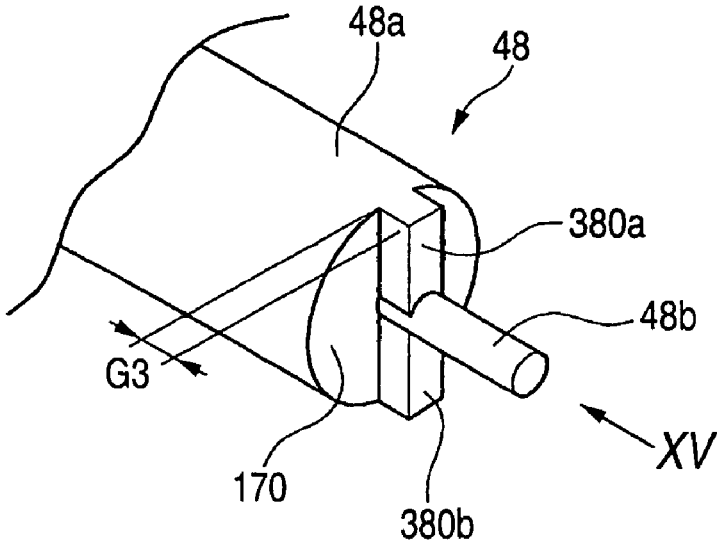
FIG. 14 is a perspective view showing a portion of a supply roller according to a fourth aspect of the invention.

FIG. 14 is a perspective view showing a portion of a supply roller 48 according to a fourth aspect of the invention. Here, only different parts from those in the first aspect will be described.

In the first aspect, the fixed member 180 (see FIG. 7) is formed separately from the supply roller main body 48*a*. In contrast, in this aspect, fixed members 380*a* and 380*b* are formed integrally with the supply roller main body 48*a*. The supply roller main body 48*a* and the fixed members 380*a* and 380*b* are formed by cutting a material (a foam material).

A thickness G3 of each of the fixed members 380*a* and 380*b* is consistent with a distance between the end surface 170 of the supply roller main body 48*a* and the inner surface 190 of the case main body 43*a* (see FIG. 7). That is, the fixed members 380*a* and 380*b* come into contact with the inner surface 190 of the case main body 43*a* and the side seal member 150.

Figure 15:
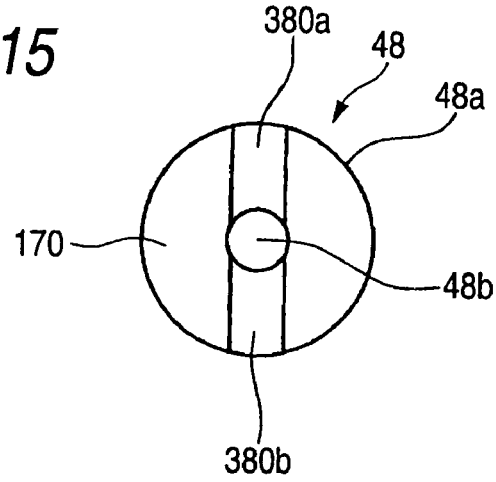
FIG. 15 is a diagram as viewed from a XV direction of FIG. 14.

In this aspect, a pair of fixed members 380*a* and 380*b* is provided symmetrically about the supply roller shaft 48*b*. FIG. 15 is a diagram as viewed from a XV direction of FIG. 14. As shown in FIG. 15, each of the fixed members 380*a* and 380*b* has a rectangular shape that extends from the supply roller shaft 48*b* radially outward.

With this aspect, the supply roller main body 48*a* and the fixed members 380*a* and 380*b* can be formed of one material. Therefore, the number of kinds of material required for forming the developer cartridge 43 can be reduced.

As described above, illustrative aspects of the invention have been described in detail in the foregoing, but these are merely an illustration and do not limit the scope described in the appended claims. Various modifications and changes of the illustrative aspects in the foregoing are included in the techniques described in the appended claims.

Figure 16:
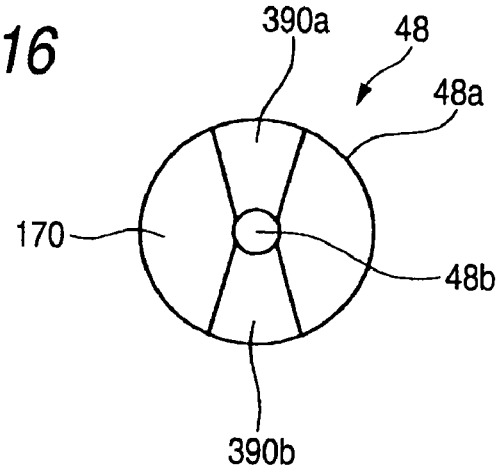
FIG. 16 shows a modification of a fixed member.

(1) The shape of the fixed member can be changed. For example, a shape shown in FIG. 16 can be adopted. FIG. 16 is a diagram showing an end surface 170 of a supply roller main body 48*a* according to this modification in front view. As shown in FIG. 16, each of fixed members 390*a* and 390*b* may have a sectoral shape that is widened from a supply roller shaft 48*b* radially outward.

Figure 17:
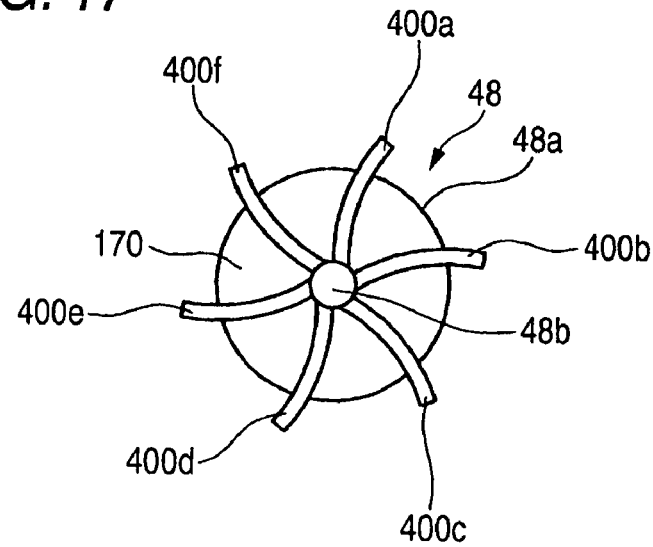
FIG. 17 shows a modification of a fixed member.

(2) Further, for example, a shape shown in FIG. 17 can be adopted. FIG. 17 is a diagram showing an end surface 170 of a supply roller main body 48*a* according to this modification in front view. In this modification, each of fixed members 400*a* to 400*f* has a vane shape that extends from a supply roller shaft 48*b* radially outward. With this shape, the toner can be effectively scraped off.

(3) A material of the fixed member can be changed to a material other than resin. For example, PET or the like can be adopted. Further, the fixed member may be formed of felt, like the upper layer 150*b* of the side seal member 150. In this case, the upper layer 150*b* of the side seal member 150 and the fixed member can be formed of the same material. Therefore, the number of kinds of material required for forming the developer cartridge 43 can be reduced.

(4) A size of the fixed member can be changed. For example, the fixed member may not come into contact with the supply roller main body 48*a*. Further, the fixed member may not come into contact with the inner surface 190 of the case main body 43*a*. Furthermore, the fixed member may not be beyond the end surface 170 of the supply roller main body 48*a*. For example, the fixed member may have a length shorter than a radius of the end surface 170 of the supply roller main body 48*a*.

In addition, the technical elements described in this specification or the drawings exert their technical availability, alone or by various combinations, so that they are not limited to the combinations described in the claims. Also, the techniques exemplified in this specification or the drawings can attain two or more objects simultaneously, and attainment of one object among them has by itself has a technical availability.

(Fifth Aspect)

(Configuration of Developing Cartridge)

Figure 18:
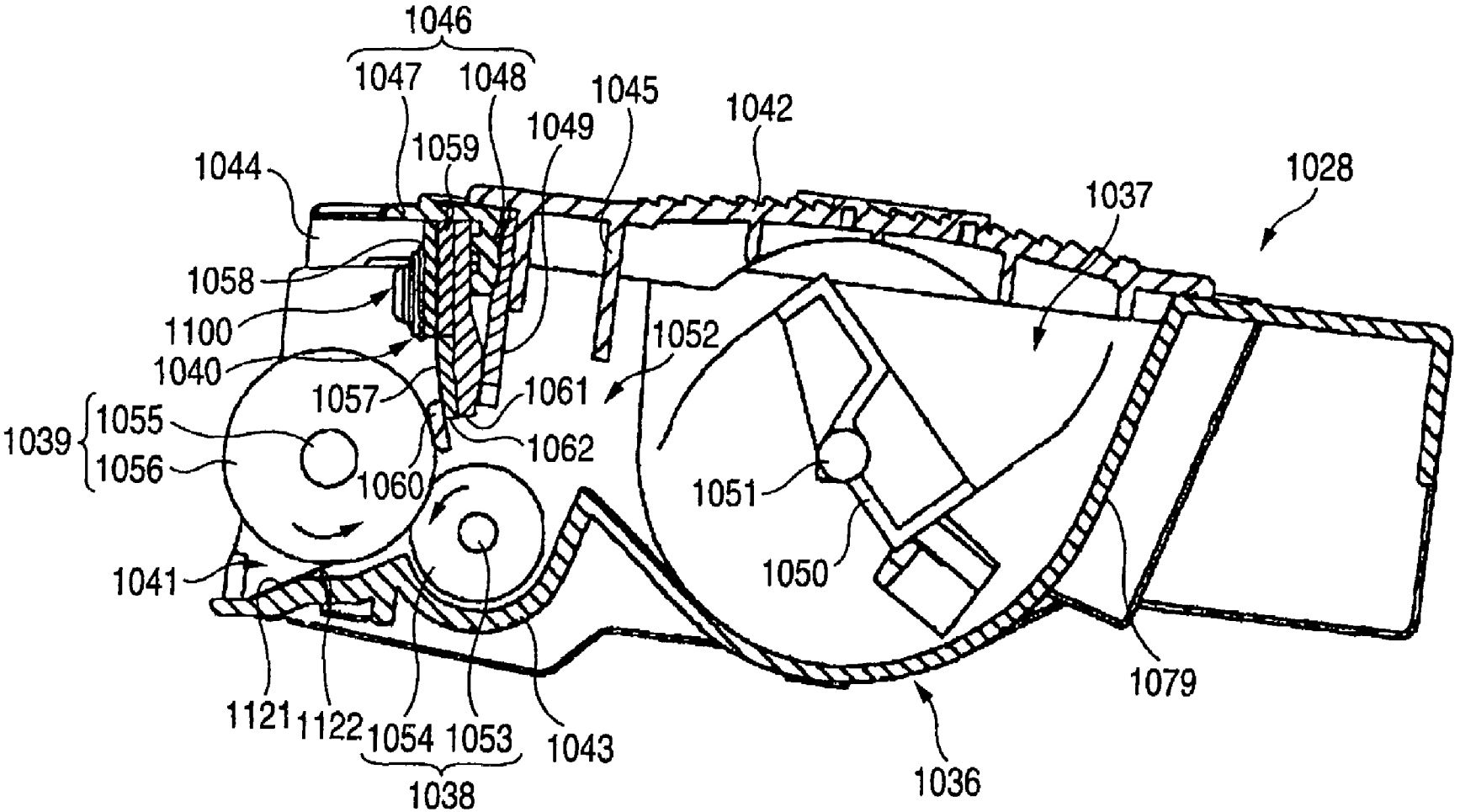
FIG. 18 is a side sectional view of a developing cartridge.

As shown in FIG. 18, a developing cartridge 1026 includes a toner case 1036 serving as a developer containing case, and a toner containing chamber 1037, a supply roller 1038, a developing roller 1039, and a blade unit 4100 serving as a layer-thickness regulating blade that are disposed in the toner case 1036.

The toner case 1036 is formed in a box shape having a longitudinal opening 1041 at its rear end. Specifically, as shown in FIGS. 18 and 19, the toner case 1036 has an upper wall 1042 and a lower wall 1043 that face each other in the up and down direction, a pair of side walls 1044 that closes a gap between the upper wall 102 and the lower wall 1043 from both sides in the widthwise direction, and a front wall 1079 that is provided to close a gap between the upper wall 1042 and the lower wall 1043 from the front side.

As shown in FIG. 18, the upper wall 1042 has a partition plate 1045 that extends from a portion close to the rear side toward the lower wall 1043 in the front-to-rear direction. An internal space of the toner case 1036 is partitioned by the partition plate 1045, and an internal space on the front side forms the toner containing chamber 1037. Further, a blade attaching portion 1046 that attaches the blade unit 1040 thereto is provided at the rear end of the upper wall 1042. The blade attaching portion 1046, the lower wall 1043, and the pair of side walls 1044 define the longitudinal opening 1041 that extends in the widthwise direction. Moreover, a direction in which the toner containing chamber 1037 and the opening 1041 are connected to each other is referred to as a connection direction. That is, in this embodiment, the connection direction and the front-to-rear direction are consistent with each other. In addition, a longitudinal direction of the opening 1041 is referred to as a widthwise direction.

As shown in FIG. 18, the blade attaching portion 1046 substantially has an L-shaped side section. Specifically, the blade attaching portion 1046 includes a plate-shaped top attaching portion 1047 that faces the lower wall 1043, extends in the widthwise direction, and has a width in the front-to-rear direction, and a front attaching portion 1048 that is bent from a front end of the top attaching portion 1047 downward, extends in the widthwise direction, has a width in the up and down direction, and has concave portions formed in a lattice shape in bottom view.

Figure 19:
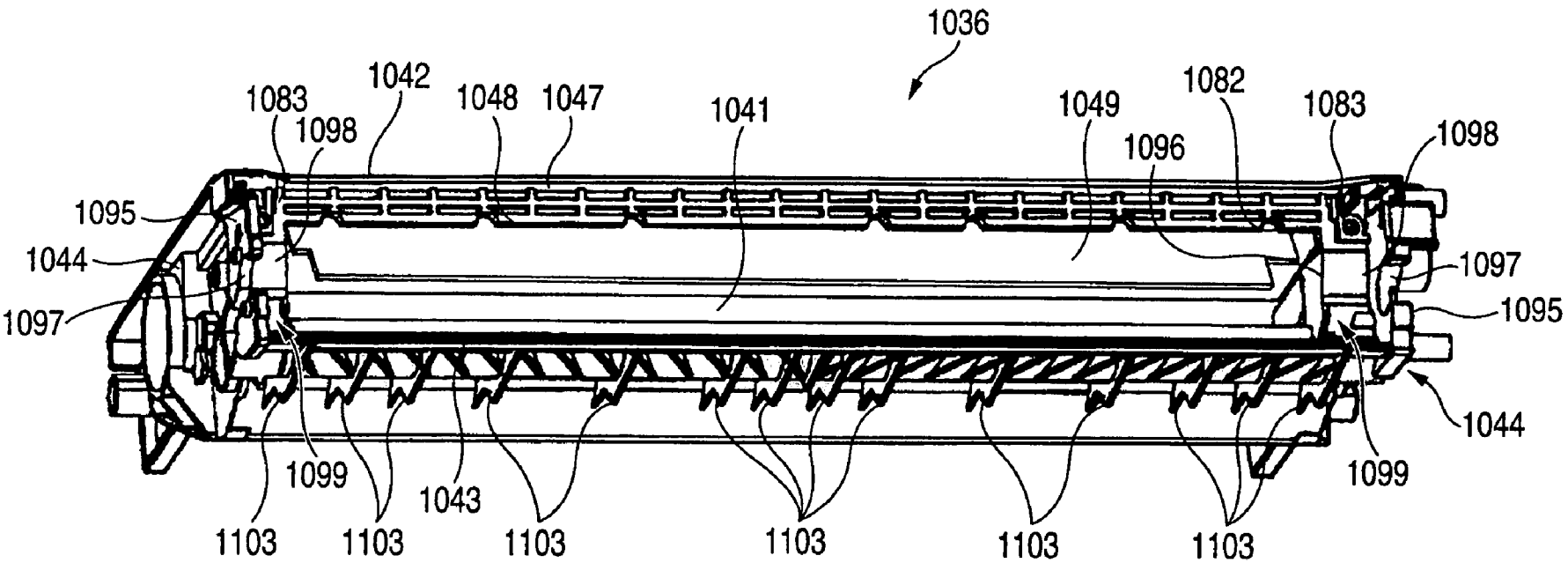
FIG. 19 is a perspective view of a toner case of the developing cartridge shown in FIG. 18.

As shown in FIG. 19, a plurality of concave portions 1082 are formed in the front attaching portion 1048 by cutting a longitudinal lower edge in a semicircle shape. Accordingly, collision against an assembling screw (not shown) that is inserted from the inside of the toner case 1036 toward the opening 1041 is avoided. Further, in the front attaching portion 1048, screw holes 1083 are formed at an interval from the concave portions 1082 longitudinally outward. When the blade unit 1040 is attached to the blade attaching portion 1046 (the front attaching portion 1048), attaching screws 1094 described below are screwed into the screw holes 1083. Then, a blade support plate 1049 is provided so as to fix the blade unit 1040 from the back side of the front attaching portion 1048 in bottom view, together with the front attaching portion 1048. A longitudinal direction of the blade support plate 1049 is formed to be slightly shorter than the length of the opening 1041 in the widthwise direction. Cutouts 1049*a* are formed at both ends of the blade support plate 1049 so as to prevent the toner stirred by a toner stirring gear 1106 serving as a rotary member described below from retaining. Further, an up and down direction of the blade support plate 1049 extends below the front attaching portion 1048 in order to support the lower end of the blade unit 1040.

As shown in FIG. 18, the front end of the lower wall 1043 extends obliquely above the front side and is connected to the front wall 1079. Further, a film disposing portion 1121 is formed at a top surface on the rear side of the lower wall 1043 to extend in the axial direction of the developing roller 1039. A lower film 1122 that is formed of polyethylene terephthalate and uniformly rubs the peripheral surface of a roller 1056 of the developing roller 1039 in the axial direction is disposed on the film disposing portion 1121. The lower film 1122 uniformly rubs the peripheral surface of the roller 1056 of the developing roller 1039 in the axial direction below the lower wall 1043, such that toner leakage between the lower wall 1043 and the developing roller 1039 can be prevented. In addition, as shown in FIG. 19, a plurality of ribs 1103 are formed at the bottom surface of the lower wall 1043 at intervals in the widthwise direction to extend in the front-to-rear direction. The ribs 1103 that are formed at both ends of the bottom surface of the lower wall 1043 serve as guide portions that extend in the front-to-rear direction along inner edges in the widthwise direction of bottom surfaces 1102 of seal disposing portions 1096 described below and fit and dispose a felt seal member 1093 described below.

As shown in FIG. 19, each of the side walls 1044 has, in the opening 1041, a support plate 1095 that supports the developing roller 1039 and the seal disposing portions 1096 on which a side seal 1091 serving as a seal member described below is disposed.

The support plate 1095 has a plate shape extending in the up and down direction, and shaft receiving holes 1097 are formed therein so as to receive a roller shaft 1055 of the developing roller 1039 described below. Each of the shaft receiving hole 1097 has a U shape in side view and an end of the rear side is opened, such that the roller shaft 1055 of the developing roller 1039 can be received through the opening.

The seal disposing portions 1096 have roller opposing surfaces 1098 that are provided adjacent to both ends in the widthwise direction of the opening 1041 relative to the support plates 1095, face axial ends of the roller 1056 of the developing roller 1039 described below and adhered portions 84 of a plate spring member 1057 of the blade unit 1040, and extend in curved shapes along an outer peripheral surface of the roller 1056. In addition, concave portions 1099 that receive a roller shaft 1053 of the supply roller 1038 described below are formed to be depressed obliquely forward in the up and down direction of the seal disposing portions 1096.

A positively chargeable non-magnetic mono-component toner is contained in the toner containing chamber 1037. As a toner, there is used a polymerized toner obtained by polymerizing a polymerizing monomer, for example, a styrene-based monomer of styrene or the like, acrylic-based monomer of acrylic acid, alkyl (C1 to C4) acrylate, alkyl (C1 to C4) metaacrylate or the like by a known polymerization method, such as suspension polymerization or the like. Such a polymerized toner is substantially globular and exhibits excellent fluidity, such that it is possible to achieve image formation of high image quality. A coloring agent, such as carbon black or the like, or a wax is mixed in the toner. In addition, an additive, such as silica, is added to the toner in order to improve fluidity. The average particle diameter of the toner is in a range of about 6 to 10 μm.

An agitator 1050 is provided in the toner containing chamber 1037 so as to stir the toner in the toner containing chamber 1037. The agitator 1050 is supported by a rotary shaft 1051 extending in the widthwise direction at a central portion of the toner containing chamber 1037 and rotates with the rotary shaft 1051 as a fulcrum. Then, the toner in the toner containing chamber 1037 is stirred and discharged from a connection port 1052 between the partition plate 1045 and the lower wall 1043 toward the rear side.

Figure 20:
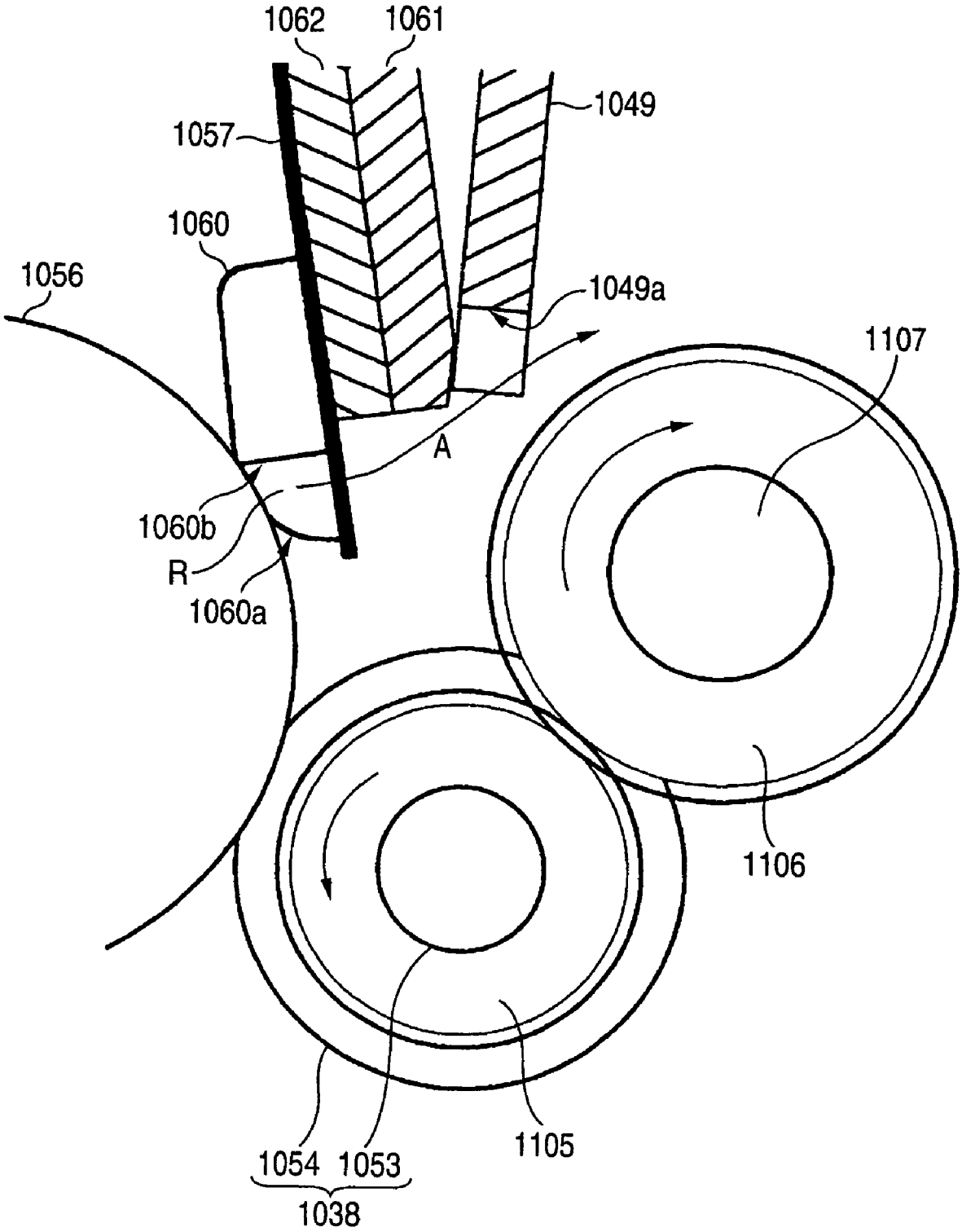
FIG. 20 is a side sectional view showing the vicinity of a pressed contact portion of a pressing rubber member of a blade unit against a developing roller as viewed from a section of a cutout.

As shown in FIG. 18, the supply roller 1038 is disposed below the connection port 1052 obliquely rearward, and is rotatably supported between the pair of side walls 1044 of the toner case 1036 so as to extend toward the opening 1041. A roller 1054 of the supply roller 1038 is provided at a gap from the seal disposing portions 1096 formed on both sides in the widthwise direction of the opening 1041 such that both longitudinal ends do not come into contact with the side seal 1091 serving as a seal member described below. The supply roller 1038 is formed by coating the metal roller shaft 1053 with the roller 1054 formed of a conductive foam material. As shown in FIG. 20, a connection gear 1105 serving as a connection member described below is provided in a gap between the roller 1054 and the seal disposing portion 1096 to be inserted into the roller shaft 1053 of the supply roller 1038. The connection gear 1105 transfers a driving force of the supply roller 1038 to a toner stirring gear 1106 serving as a rotary member described below.

As shown in FIGS. 18 and 19, the developing roller 1039 is disposed in the opening 1041 in the widthwise direction on the rear side of the supply roller 1038 and is rotatably supported between the support plates 1095 of the pair of side walls 1044 of the toner case 1036. Further, the developing roller 1039 faces and comes into contact with the photosensitive drum 1028 in the front-to-rear direction in a state where a portion of the surface of the developing roller 1039 is disposed to protrude rearward from the opening 1041 of the toner case 1036 to be then exposed, and the developing cartridge 1026 is mounted on the drum cartridge 1025. The developing roller 1039 is formed by coating the metal roller shaft 1055 with the roller 1056 formed of a conductive rubber material. In the roller 1056 of the developing roller 1039, the surface of a roller layer formed of conductive urethane rubber or silicon rubber containing carbon particles is coated with a coat layer formed of urethane rubber or silicon rubber containing fluorine. Further, the roller 1056 of the developing roller 1039 is disposed to come into contact with the roller 1054 of the supply roller 1038 such that both rollers are compressed.

As indicated by an arrow, a portion of the supply roller 1038 that comes into contact with the developing roller 1039 rotates in a counterclockwise direction from the above toward the below. Further, as indicated by an arrow, a portion of the developing roller 1039 that is exposed from the toner case 1036 rotates in a counterclockwise direction from the above toward the below.

(Configuration of Blade Unit)

Figure 21:
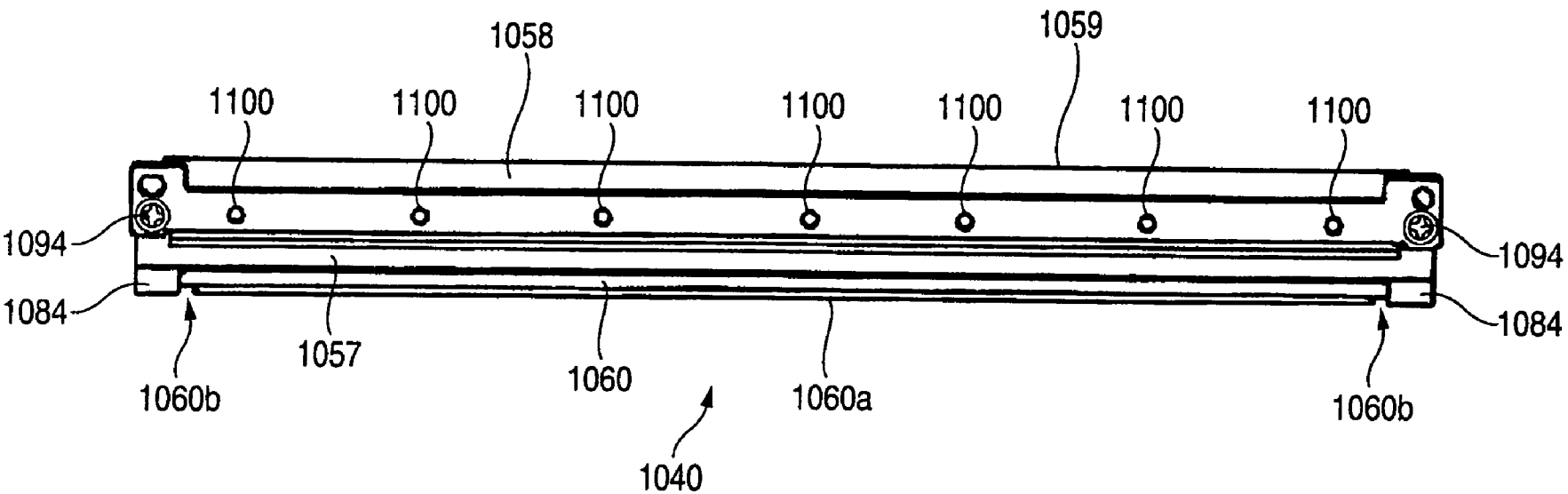
FIG. 21 is a front view of a blade unit as viewed from an opening.

Next, the configuration of the blade unit. 1040 will be described with reference to FIGS. 18 to 21. FIG. 21 is a front view of the blade unit as viewed from the opening.

As shown in FIGS. 18 and 21, the blade unit 1040 includes a plate spring member 1057, a warp preventing member 1058 and a reinforcing plate 1059 that support the plate spring member 1057, and a plurality of assembling screws (not shown) that fix them to one another. The individual parts constituting the blade unit 1040 are formed of a rigid material, that is, a metal. As described below, the blade unit 1040 is attached such that the reinforcing plate 1059 faces the front attaching portion 1048 and the blade support plate 1049 in a state where the plate spring member 1057 is interposed between the warp preventing member 1058 and the reinforcing plate 1059.

The plate spring member 1057 is formed of a thin metal plate spring material, and is formed in a rectangular shape having the substantially same width as the width in the widthwise direction of the roller 1056 of the developing roller 1039. An upper end of the plate spring member 1057 is interposed between the warp preventing member 58 and the reinforcing member 1059. Further, as shown in FIGS. 20 and 21, a pressing rubber member 1060 serving as a layer-thickness regulating unit is provided at a lower end of the plate spring member 1057 to extend in a longitudinal direction of the plate spring member 1057. The pressing rubber member 1060 is formed of an insulating silicon rubber and has a lower edge **1060*a* having a curvature R. The pressing rubber member 1060 has a rectangular sectional shape. The pressing rubber member 1060 is not formed at both longitudinal ends of the plate spring member 1057. The adhered portions 1084, to which the upper end of the felt seal member 1093 described below is adhered, are formed at both longitudinal ends. The lower edge 1060*a* of the pressing rubber member 1060 does not extend over the adhered portions 1084 in the longitudinal direction, and both longitudinal ends form cutouts 1060*b*. The cutouts 1060*b* are formed by cutting the lower edge 1060*a* having the curvature R at both ends of the plate spring member 1057. Portions of the cutouts 1060*b* pressed into contact with the developing roller 1039** do not have the curvature R, but have a predetermined angle.

At positions facing screw holes described below in the front-to-rear direction in the longitudinal direction of the plate spring member 1057, a plurality of insertion holes 1100, into which the individual assembling screws are inserted, are formed to pass through the plate spring member 1057 in a thicknesswise direction. The insertion holes 1100 are disposed inside both edges of the pressing rubber member 1060 in the longitudinal direction of the plate spring member 1057. On both outer sides of the insertion holes in the longitudinal direction of the plate spring member 1057, attaching holes (not shown), into which the attaching screws 1094 are inserted, are formed to pass through the plate spring member 1057 in the thicknesswise direction. The attaching holes are formed at positions corresponding to the screw holes 1083 formed in the front attaching portion 1048 of the blade attaching portion 1046 in the front-to-rear direction.

The warp preventing member 1058 extends in the longitudinal direction of the plate spring member 1057 and is disposed to face the upper end of the surface of the plate spring member 1057.

The reinforcing plate 1059 is formed of a metal plate having a slender rectangular shape. The reinforcing plate 1059 is formed to extend in the longitudinal direction of the plate spring member 1057 and to be shorter than each of the attaching holes of the plate spring member 1057. On the back surface of the plate spring member 1057, the reinforcing plate 1059 faces the warp preventing member 1058 with the plate spring member 1057 interposed therebetween. Then, the reinforcing plate 1059 supports and reinforces the plate spring member 1057 in a state where the upper end of the plate spring member 1057 is interposed between the plate spring member 1057 and the warp preventing member 1058. At both longitudinal ends of the reinforcing plate 1059, screws holes (not shown), in which the assembling screws are respectively screwed, are formed. The plate spring member 1057, the warp preventing member 1058, and the reinforcing plate 1059 are fixed to one another by the plurality of assembling screws.

As shown in FIG. 18, the blade unit 1040 is attached to face the blade attaching portion 1046, and the warp preventing member 1058 is attached to face the upper attaching portion 1047. Further, the reinforcing plate 1059 is attached to face the front attaching portion 1048 and the blade support plate 1049. A sponge member 1061 fixes the front attaching portion 1048 to the blade support plate 1049, and a sponge member 1062 fixes the lower end of the plate spring member 1057 to the sponge member 1061. As a result, the blade unit 1040 is reliably fixed to the front attaching portion 1048 and the blade support plate 1049. The sponge members 61 and 62 bury gaps between the blade unit 1040, and the front attaching portion 1048 and the blade support plate 1049, thereby to prevent the toner from entering the gaps.

In a state where the blade unit 1040 is attached to the blade attaching portion 1046, the lower end of the plate spring member 1057 faces the roller 1056 of the developing roller 1039 from the front side, and the pressing rubber member 1060 is pressed into contact with the roller 1056 by an elastic force of the plate spring member 1057. The toner discharged from the connection port 1052 into the internal space on the rear side of the toner case 1036 by the rotation of the agitator 1050 is supplied onto the roller 1056 of the developing roller 1039 by the rotation of the supply roller 1038. At this time, the toner is positively frictionized and charged between the roller 1054 of the supply roller 1038 and the roller 1056 of the developing roller 1039. The toner supplied onto the roller 1056 of the developing roller 1039 enters between the pressing rubber member 1060 of the blade unit 1040 and the roller 1056 of the developing roller 1039 according to the rotation of the developing roller 1039 and then is frictionized and charged. Then, the toner of a thin layer having a predetermined thickness is formed and carried on the roller 1056 of the developing roller 1039.

As shown in FIG. 20, since the lower edge 1060*a* has the curvature R, the lower edge 1060*a* of the pressing rubber member 1060 and the developing roller 1039 come into planar contact with each other, a pressing force against the developing roller 1039 at the lower edge 1060*a* is dispersed. Accordingly, at a portion where the lower edge 1060*a* and the developing roller 1039 come into contact with each other, the toner of a thin layer having a predetermined thickness is formed and carried on the roller 1056 of the developing roller 1039. Meanwhile, since the cutout 1060*b* close to the developing roller 1039 has a predetermined angle, the cutout 1060*b* of the pressing rubber member 1060 and the developing roller 1039 come into linear contact with each other, and thus a pressing force against the developing roller 1039 at the cutout 1060*b* is concentrated. Accordingly, at a portion where the cutout 1060*b* and the developing roller 1039 come into contact with each other, the toner on the roller 1056 is almost scraped. Therefore, the toner is not almost carried on both longitudinal ends of the roller 1056 of the developing roller 1039. As a result, it is possible to prevent leakage of the toner carried on both longitudinal ends of the roller 1056 from a gap between the roller 1056 and the side seal 1091 described below coming into contact with both longitudinal ends of the roller 1056, a gap between the side seal 1091 and both longitudinal ends of the pressing rubber member 1060, and the like.

(Configuration of Side Seal)

Figure 22:
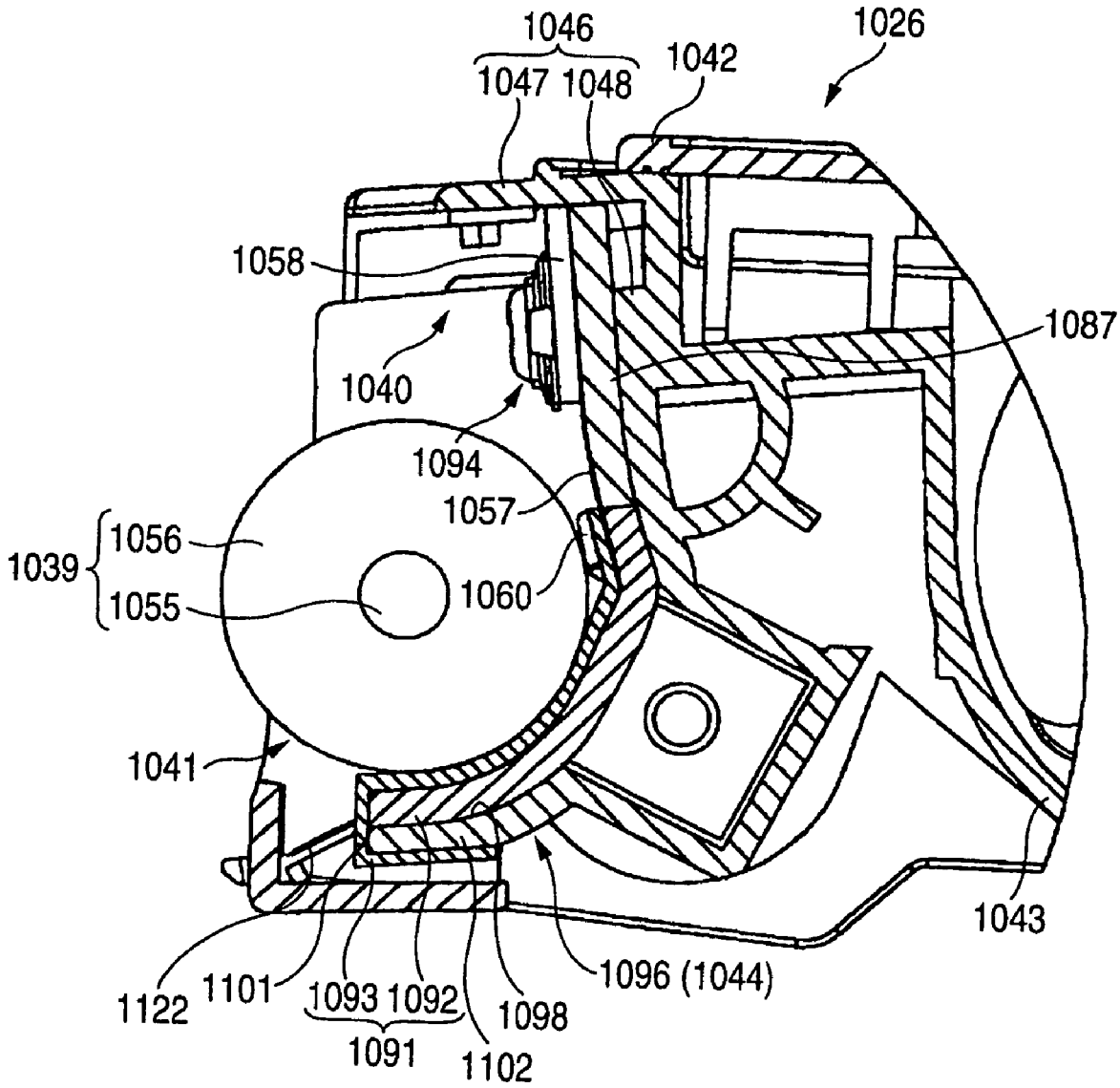
FIG. 22 is a side sectional view showing the configuration of an opening of a toner case.
Figure 23:
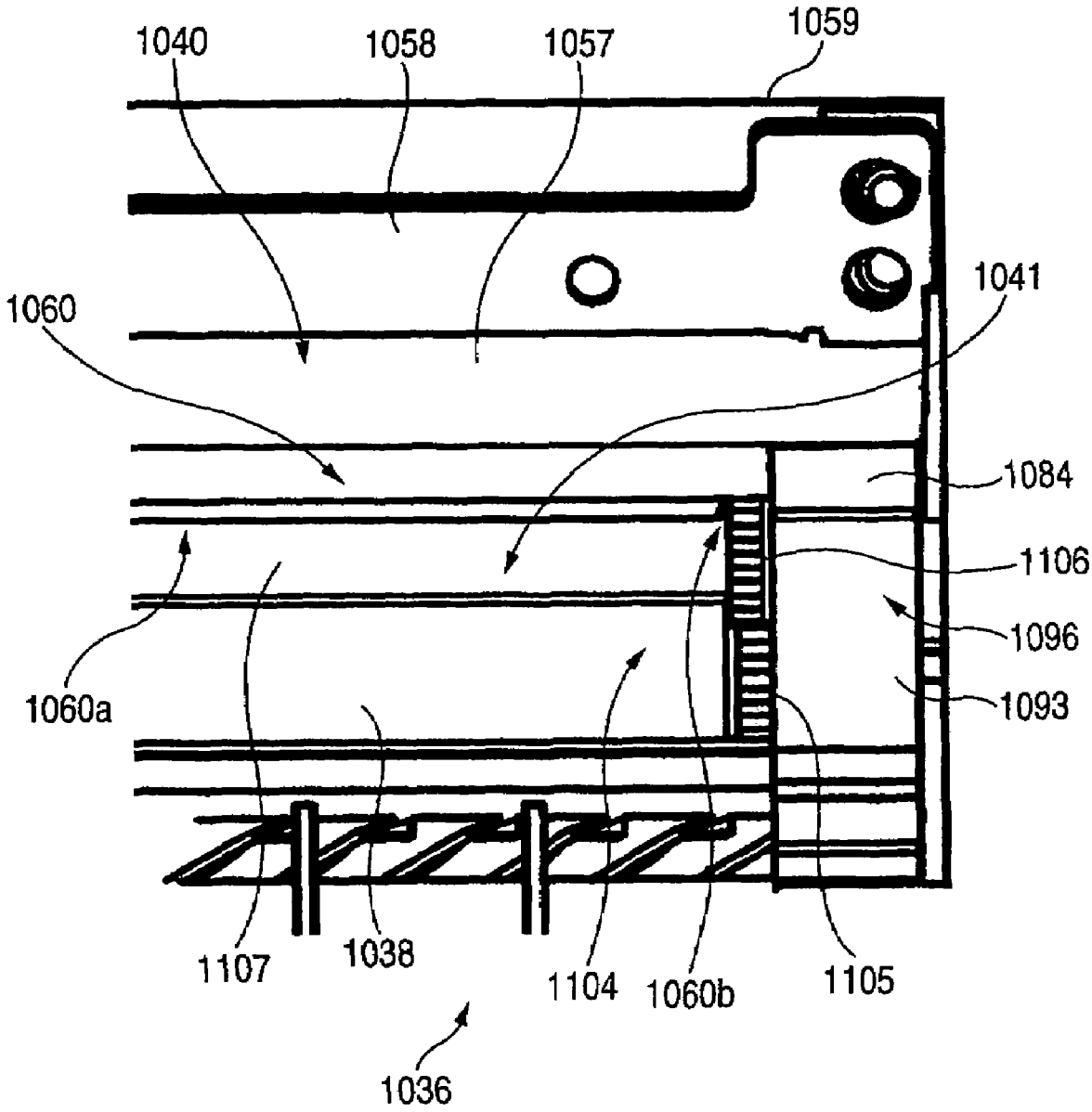
FIG. 23 is a bottom view of the toner case showing a vicinity of a toner stirring mechanism.

Next, the configuration of the side seal 1091 will be described with reference to FIGS. 22 and 23. FIG. 22 is a side sectional view showing the configuration of the opening of the toner case. FIG. 23 is a bottom view of the toner case 1036 showing a vicinity of a toner stirring mechanism 1104. FIG. 23 shows the toner caser 1036 in a state where the developing roller 1039 is removed.

As shown in FIGS. 22 and 23, in the developing cartridge 1026, a side seal 1091 serving as a seal member for preventing leakage of the toner from both axial ends of the developing roller 1039 is disposed at a roller opposing surface 1098 of the seal disposing portion 96 of each side wall 1044. The side seal 1091 is provided to rub the surface of the roller 1056 at both axial ends of the roller 1056 of the developing roller 1039. The side seal 1091 has a sponge seal member 1092 and a felt seal member 1093 that is deposited on the sponge seal member 1092.

The sponge seal member 1092 is formed of a sponge material, such as urethane foam or the like. More specifically, among sponge materials, a sponge material (trade name: PORON, manufactured by Rogers Inoac Corporation) of urethane foam having a relatively high hardness is used. The sponge seal member 1092 is disposed on the roller opposing surface 1098 of the seal disposing portion 1096 to extend in the up and down direction along the rotation direction of the developing roller 1039. An upper end surface of the sponge seal member 1092 on a downstream side of the rotation direction is connected adjacent to a lower end surface of a blade back seal 1087 closing a gap of the blade attaching portion 46 to which the blade unit 1040 is attached. A lower end surface of the sponge seal member 1092 on an upstream side of the rotation direction is flush with a rear end surface 1101 of the seal disposing portion 1096 in the front-to-rear direction. The upper end of the sponge seal member 1092 is interposed between the plate spring member 1057 and the seal disposing portion 1096. The sponge seal member 1092 is adhered to the roller opposing surface 1098 of the seal disposing portion 1096 by a double-faced adhesive tape.

As shown in FIGS. 22 and 23, the felt seal member 1093 is formed of felt containing a polyester-based fiber. The felt seal member 1093 is attached to extend along the sponge seal member 1092 over the adhered portions 1084 of the plate spring member 1057 and the sponge seal member 1092, to pass through a rear end surface 1101 of the seal disposing portion 1096, and to bend under a lower surface 1102 of the seal disposing portion 106. A surface of the felt seal member 1093 facing the roller 1056 of the developing roller 1039 forms a rubbing surface that rubs against the roller 1056. With this arrangement, the side seal 1091 is adjacent to the cutout 1060*b*.

(<Configuration of Toner Stirring Mechanism)

Figure 24:
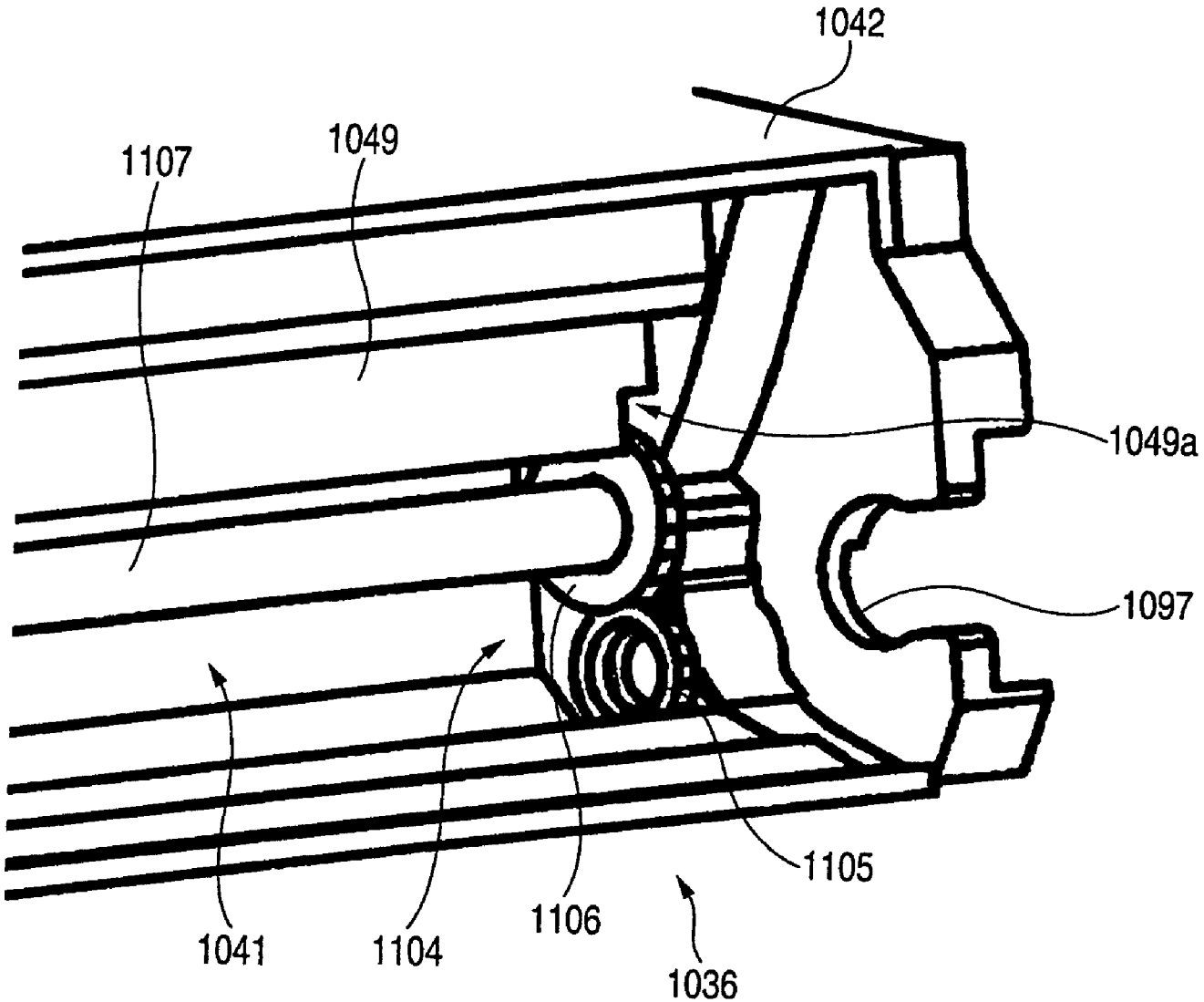
FIG. 24 is an enlarged perspective view of a vicinity of the toner stirring mechanism in the toner case of the developing cartridge, on which a developing roller and a supply roller are not mounted, as viewed from an opening.

Next, the toner stirring mechanism 1104 will be described with reference to FIGS. 20, 23, and 24. FIG. 24 is an enlarged perspective view of a vicinity of the toner stirring mechanism in the toner case of the developing cartridge, on which the developing roller and the supply roller are not mounted, as viewed from the opening. FIG. 24 shows the toner case 1036 in a state where the blade unit 1040, the paper feed roller 1038, and the developing roller 1039 are removed.

The toner stirring mechanism 1104 has a connection gear 1105 serving as a connection member, a toner stirring gear 1106 serving as a rotary member, and a shaft 1107.

The connection gear 1105 is provided to be inserted into the roller shaft 1053 of the supply roller 1038. The connection gear 1105 transfers a driving force when the supply roller 1038 is driven to be rotated by a driving motor (not shown), to the toner stirring gear 1106. Since the connection gear 1105 is inserted into the roller shaft 1053 of the supply roller 1038, as indicated by an arrow in FIG. 20, the connection gear 1105 rotates in a counterclockwise direction.

The toner stirring gear 1106 is connected to the connection gear 1105 and is positioned in front of the cutout 1060*b* and below a vicinity of the front side of the cutout 1049*a* of the blade support plate 1049. The toner stirring gear 1106 receives the driving force when the connection gear 1105 rotates together with the roller shaft 1053 of the supply roller 1038 and rotates in a clockwise direction, as indicated by an arrow in FIG. 20. With the rotation of the toner stirring gear 1106, the toner scraped from the surface of the roller 1056 of the developing roller 1039 by the cutout 1060*b* passes between the cutout 1049*a* of the blade support plate 1049 and the toner stirring gear 1106 and returns to the toner containing chamber 1037.

Both longitudinal ends of the shaft 1107 are rotatably supported by shaft receiving holes (not shown) that are formed in the support plate 1095. The toner stirring gear 1106 is inserted into and fixed to the shaft 1107. Moreover, in the blade support plate 1049, the toner stirring gear 1106 that is inserted into and fixed to the shaft 1107 is disposed below one cutout 1049*a* that is not shown in FIGS. 20 and 24.

The shaft 1107 is parallel to the roller shaft 1053 of the supply roller 1038 or the roller shaft 1055 of the developing roller 1039, is inserted into the two toner stirring gears 1106 that rotate by driving force transferred from the connection gear 1105 and supports them, thereby achieving stable rotation of the toner stirring gear 1106. In addition, since the shaft 1010 is connected to and drags the two toner stirring gears 1106, two connection gears 1105 that are connected to the two toner stirring gears 1106, respectively, do not need to be provided and a driving force does not needs to be transferred, but only one connection gear 1105 is sufficient. Therefore, the number of parts can be reduced, and thus costs can be reduced.

When the toner stirring mechanism 1104 is provided in the toner case 1036 of the developing cartridge 1026, by using the driving force of the supply roller 1038, the toner retained in the toner case 1036 in the vicinity of the cutout 1060*b* can be stirred and return to the toner containing chamber 1037 again. Therefore, it is possible to prevent the toner scraped from the developing roller 1039 by the cutout 1060*b* from being accumulated on the back side as viewed from the opening 1041 of the cutout 1060*b* and then to prevent occurrence of a toner aggregate. Therefore, it is possible to prevent the toner aggregate from pressing the side seal 1091 adjacent to the cutout 1060*b* and entering a gap between the side seal 1091 and the seal disposing portion 1096 and then to prevent toner leakage.

The process cartridge 1018 includes the developing cartridge 1026 that can prevent toner leakage from a gap in the vicinity of the side seal 1091, and thus it is possible to prevent toner leakage from the developing cartridge 1026. In addition, in the laser printer including the process cartridge 1018, it is possible to prevent toner leakage from the developing cartridge 1026 or the process cartridge 1018.

<Configuration of Fixing Unit>

The fixing unit 19 is provided on the rear side of the process cartridge 18. The fixing unit 19 has a fixing frame 67, and a heating roller 68 and a pressing roller 69 in the fixing frame 67. The heating roller 68 has a metal tube and a halogen lamp provided in the metal tube for heating. The heating roller 68 is driven to be rotated by an input of power from a motor (not shown). The pressing roller 69 is disposed below the heating roller 68 to face and press the heating roller 68. The pressing roller 69 is formed by coating a metal roller shaft with a roller formed of a rubber material and is driven according to the rotation of the heating roller 68.

MODIFICATION

Although the invention has been described by way of the embodiment, the invention is not limited to the embodiment. Various changes and modifications can be made within the scope without departing from the technical scope of the invention.

Although the driving force of the supply roller 1038 is transferred to the toner stirring gear 1106 by the connection gear 1105 in the embodiment, instead of the connection gear 1105, a separate driving motor from the motor that rotates the supply roller 1038 may be provided, and the shaft 1107 may be directly rotated by the driving motor so as to drag the toner stirring gear 1106.

As described above, when the separate driving motor is provided, the shape of the toner stirring gear 1106 may be not a gear. Any shape can be used as long as it can stir the toner in the toner case 36 in the vicinity of the cutout 1060*b*.

What is claimed is:

1. A developing device comprising:

a developer containing case that contains a developer and comprises a case main body and a supply roller that is rotatably supported on the case main body, wherein the supply roller has a rotary shaft, a cylindrical roller main body that covers the rotary shaft, and a fixed member that is fixed to at least one of the rotary shaft and the roller main body, a gap is provided between an end surface of the roller main body and an inner surface of the case main body, and the fixed member partially occupies the gap and has a volume half or less of a volume of the gap.

2. The developing device according to claim 1, wherein the fixed member is formed separately from the roller main body.

3. The developing device according to claim 1, wherein the fixed member is formed integrally with the roller main body.

4. The developing device according to claim 3, wherein the roller main body and the fixed member are formed by cutting.

5. The developing device according to claim 1, wherein, in plan view of the end surface of the roller main body, the fixed member has a vane shape that extends from a vicinity of a center of the end surface of the roller main body radially outward.

6. The developing device according to claim 1, wherein, in plan view of the end surface of the roller main body, the fixed member extends beyond the end surface of the roller main body outward.

7. The developing device according to claim 1, wherein the fixed member extends from the end surface of the roller main body to the inner surface of the case main body.

8. A developing device comprising:

a developing containing case that contains a developer and comprises a case main body and a supply roller that is rotatably supported on the case main body, wherein the supply roller has a rotary shaft, a cylindrical roller main body that covers the rotary shaft, and a fixed member that is fixed to at least one of the rotary shaft and the roller main body, a gap is provided between an end surface of the roller main body and an inner surface of the case main body, and the fixed member partially occupies the gap, and in plan view of the end surface of the roller main body, the fixed member has a rectangular shape that extends from a vicinity of a center of the end surface of the roller main body radially outward.

9. A developing device comprising:

a developer containing case that contains a developer and comprises a case main body and a supply roller that is rotatably supported on the case main body, wherein the supply roller has a rotary shaft, a cylindrical roller main body that covers the rotary shaft, and a fixed member that is fixed to at least one of the rotary shaft and the roller main body, a gap is provided between an end surface of the roller main body and an inner surface of the case main body, and the fixed member partially occupies the gap, and in plan view of the end surface of the roller main body, the fixed member extends from a vicinity of a center of the end surface of the roller main body radially outward and bends in a reverse rotation direction of the supply roller.

10. A developing device comprising:

a developer containing case that contains a developer and comprises a case main body and a supply roller that is rotatably supported on the case main body, wherein the supply roller has a rotary shaft, a cylindrical roller main body that covers the rotary shaft, and a fixed member that is fixed to at least one of the rotary shaft and the roller main body, a gap is provided between an end surface of the roller main body and an inner surface of the case main body, and the fixed member partially occupies the gap, and in plan view of the end surface of the roller main body, the fixed member has a sectoral shape that is widened from a vicinity of a center of the end surface of the roller main body radially outward.

11. A developer device comprising:

a developer containing case that contains a developer and comprises a case main body and a supply roller that is rotatably supported on the case main body;

a developing roller that is rotatably supported on the case main body; and a side seal member that is fixed to the case main body, wherein the developing roller comes into contact with the supply roller and is disposed outside the case main body, the case main body has a region that opposes a rotary surface of the developing roller at an end in a rotary shaft direction of the developing roller, the side seal member is disposed in the opposing region and comes into contact with the developing roller, the end surface of the roller main body of the supply roller opposes the case main body and the side seal member, the supply roller has a rotary shaft, a cylindrical roller main body that covers the rotary shaft, and a fixed member that is fixed to at least one of the rotary shaft and the roller main body, a gap is provided between an end surface of the roller main body and an inner surface of the case main body, the fixed member partially occupies the gap, the side seal member has a first layer that is fixed to the ease main body, and a second layer that is laminated on the first layer and comes into contact with the developing roller, the first layer is formed of an elastic material, and the second layer is formed of a fiber material.

12. The developing device according to claim 11, wherein the fixed member is formed of the same fiber material as the second layer of the side seal member.

13. A developing device comprising:

a developer containing case that contains a developer and comprises a case main body and a supply roller that is rotatably supported on the case main body;

a developing roller that is rotatably supported on the case main body;

a side seal member that is fixed to the case main body; and a layer-thickness regulating member that is fixed to the main body case, comes into contact with the developing roller, and regulates a thickness of the developer carried on the developing roller, wherein a cutout is provided at a predetermined position of the layer-thickness regulating member, the predetermined position is a position corresponding to the end in a rotary shaft direction of the developing roller, the fixed member has such a length that enters the cutout during rotation of the supply roller, the developing roller comes into contact wit the supply roller and is disposed outside the case main body, the case main body has a region that opposes a rotary surface of the developing roller at an end in a rotary shaft direction of the developing roller, the side seal member is disposed in the opposing region and comes into contact with the developing roller, the end surface of the roller main body of the supply roller opposes the case main body and the side seat member, the supply roller has a rotary shaft, a cylindrical roller main body that covers the rotary shaft, and a fixed member that is fixed to at least one of the rotary shaft and the roller main body, a gap is provided between an end surface of the roller main body and an inner surface of the case main body, and the fixed member partially occupies the gap.

14. A developing device comprising:

a developer containing case that contains a developer and has an opening;

a developing roller that is rotatably provided in the developer containing case and extending along the opening to carry the developer;

a seal member that is provided between ends of the opening in a direction of a developing roller shaft and axial ends of the developing roller;

a layer-thickness regulating blade having a layer-thickness regulating portion that is provided in the developer containing case so as to extend toward the opening and comes into contact with the developing roller, and a cutout that comes into contact with the seal member;

a rotary member that is provided at a position corresponding to the cutout in the developer containing case and rotates around an axis parallel to a developing roller shaft;

a supply roller that is rotatably provided in the developer containing case extending along the opening and supplies the developer to the developing roller; and a connection member that connects the supply roller and the rotary member and transfers a driving force of the supply roller to the rotary member.

15. The developing device according to claim 14, wherein the supply roller does not come into contact with the seal member.

* * * * *

UNITED STATES PATENT AND TRADEMARK OFFICE

CERTIFICATE OF CORRECTION

PATENT NO. : 7,627,264 B2
APPLICATION NO. : 11/528687
DATED : December 1, 2009
INVENTOR(S) : Matsushita et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 542 days.

Signed and Sealed this

Second Day of November, 2010

David J. Kappos

David J. Kappos
*Director of the United States Patent and Trademark Office*